US008725014B2

(12) United States Patent
Hotomi et al.

(10) Patent No.: US 8,725,014 B2
(45) Date of Patent: May 13, 2014

(54) IMAGE FORMING APPARATUS

(75) Inventors: Daigo Hotomi, Moriya (JP); Akihiro Maeda, Tokyo (JP); Motohiro Ogura, Kashiwa (JP)

(73) Assignee: Canon Finetech Inc., Misato-shi (JP)

( * ) Notice: Subject to any disclaimer, the term of this patent is extended or adjusted under 35 U.S.C. 154(b) by 346 days.

(21) Appl. No.: 12/975,883

(22) Filed: Dec. 22, 2010

(65) Prior Publication Data

US 2011/0158664 A1 Jun. 30, 2011

(30) Foreign Application Priority Data

Dec. 24, 2009 (JP) ..... 2009-293028
Dec. 14, 2010 (JP) ..... 2010-278268

(51) Int. Cl.
*G03G 15/00* (2006.01)

(52) U.S. Cl.
USPC ..... 399/43

(58) Field of Classification Search
USPC ..... 399/43, 50
See application file for complete search history.

(56) References Cited

U.S. PATENT DOCUMENTS

| | | | | |
|---|---|---|---|---|
| 6,449,449 | B1 * | 9/2002 | Kadonaga | 399/176 |
| 6,532,347 | B2 | 3/2003 | Watanabe et al. | |
| 6,917,770 | B2 * | 7/2005 | Bae et al. | 399/44 |
| 7,630,659 | B2 | 12/2009 | Uchitani et al. | |
| 8,483,585 | B2 * | 7/2013 | Booth et al. | 399/44 |
| 2001/0019669 | A1 | 9/2001 | Watanabe et al. | |
| 2006/0251438 | A1 | 11/2006 | Uchitani et al. | |
| 2010/0247122 | A1 * | 9/2010 | Hagiwara | 399/44 |

FOREIGN PATENT DOCUMENTS

| | | | |
|---|---|---|---|
| CN | 1862407 | A | 11/2006 |
| JP | 9-179383 | A | 7/1997 |
| JP | 9-311530 | A | 12/1997 |
| JP | 2001-201921 | A | 7/2001 |
| JP | 2006-343710 | A | 12/2006 |

OTHER PUBLICATIONS

Office Action dated Oct. 29, 2012, in Chinese Application No. 201010621552.6.
Notice of Reason for Rejection dated Oct. 21, 2011, in Japanese Application No. 2010-278268.

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

Provided is an image forming apparatus capable of performing stable charging and thus stable image formation over a long term by changing a charge control method based on various environments. An engine control section serves as a first applied voltage determining unit, obtains a relationship between an applied voltage and a discharge current amount to a charging roller, and determines a voltage value of an applied voltage corresponding to a predetermined discharge current amount. The engine control section serves as a second applied voltage determining unit and determines a voltage value of a voltage to be applied to the charging roller based on the environment information detected by the environmental sensor. The engine control section selects, as the voltage to be applied to the charging roller, any one of the voltage values determined by the first and the second applied voltage determining units based on the environment information.

14 Claims, 13 Drawing Sheets

IMAGE FORMING APPARATUS

BACKGROUND OF THE INVENTION

1. Field of the Invention

The present invention relates to an image forming apparatus for forming images, and more particularly, to an image forming apparatus using an electrophotographic process.

2. Description of the Related Art

In a printing apparatus for printing images by an electrophotographic process, a surface of a drum-type electrophotographic photosensitive member (hereinafter, referred to as photosensitive drum) is uniformly charged to a predetermined potential by a charging unit. In the charging unit, corona charging which is non-contact charging is generally performed. In the corona charging, a high voltage is applied to a thin corona discharge wire to generate corona, and the corona acts on the surface of the photosensitive drum which is to be charged.

In recent years, a contact charging process which is advantageous in terms of a low-voltage process, a low ozone generation amount, and a low cost is becoming mainstream. The contact charging process is a process for bringing, for example, a roller charging member (hereinafter, referred to as charging roller) into contact with the surface of the photosensitive drum and applying a voltage to the charging roller to charge the photosensitive drum. The voltage applied to the charging roller may be only a DC voltage. However, when an AC voltage is applied to alternately generate positive discharging and negative discharging, more uniform charging may be achieved. For example, it is known that an AC voltage having a peak-to-peak voltage (Vpp) which is twice or more larger than a threshold voltage (charge start voltage), at which discharging to the photosensitive drum is started when a DC voltage is applied, is superimposed on the DC voltage to obtain an oscillation voltage to be applied, to thereby uniformly charge the photosensitive member.

When a sinusoidal voltage is applied to the charging roller, the voltage causes a resistive load current to flow into a resistive load between the charging roller and the photosensitive drum, a capacitive load current to flow into a capacitive load between the charging roller and the photosensitive drum, and a discharge current to flow between the charging roller and the photosensitive drum. As a result, the sum of currents flows into the charging roller. As is empirically known, a discharge current amount is desirably maintained to a value equal to or larger than a predetermined value in order to obtain stable charging. Note that, when the discharge current amount becomes equal to or larger than the predetermined value in a high-humidity environment, image defects may occur.

In recent years, high image quality and high stability have been desired, and discharge current control for controlling the discharge current amount has been proposed (see Japanese Patent Application Laid-Open No. 2001-201921).

Image forming apparatuses have been used in a wider range of environments, and increasingly used particularly in a low-temperature and low-humidity environment. In line with this trend, a reduction in cost is strongly desired, and hence the image forming apparatuses are required to be used with a low peak-to-peak voltage (Vpp).

When the discharge current control is employed in the low-temperature and low-humidity environment, a resistance of a charging device increases, and hence a necessary discharge current amount increases. In addition, it is necessary to apply a voltage for computation, and hence the main body of the printing apparatus is required to have a capacity higher than necessary. Therefore, significant power is wasted.

SUMMARY OF THE INVENTION

Therefore, the present invention provides an image forming apparatus capable of performing stable charging and thus stable image formation over a long term by changing a method of determining a voltage value applied to a charging device.

Moreover, the present invention provides an image forming apparatus capable of performing charging suitable for an environmental condition and thus performing image formation suitable for the environmental condition by changing a method of determining a voltage value applied to a charging device based on a predetermined environmental condition.

According to the present invention, an image forming apparatus includes: an image bearing member for bearing an image; a charging unit for charging the image bearing member; a first applied voltage determining unit for obtaining a relationship between a voltage applied to the charging unit and a discharge current amount and determining a voltage value of the applied voltage corresponding to a predetermined discharge current amount; a second applied voltage determining unit for determining a voltage value of a voltage to be applied to the charging unit from voltage values stored in advance in a storage unit; and a control unit for controlling the charging unit based on the voltage value determined by one of the first applied voltage determining unit and the second applied voltage determining unit.

According to the present invention, the first and second applied voltage determining units for determining the voltage values of the voltages applied to the charging unit are provided to select any one of the values, and hence an image forming apparatus which is stable over a long term and low in cost may be provided.

Further features of the present invention will become apparent from the following description of exemplary embodiments with reference to the attached drawings.

DESCRIPTION OF THE EMBODIMENT

Hereinafter, an embodiment of the present invention is described in detail with reference to the attached drawings.

[Image Forming Apparatus]

Figure 1:
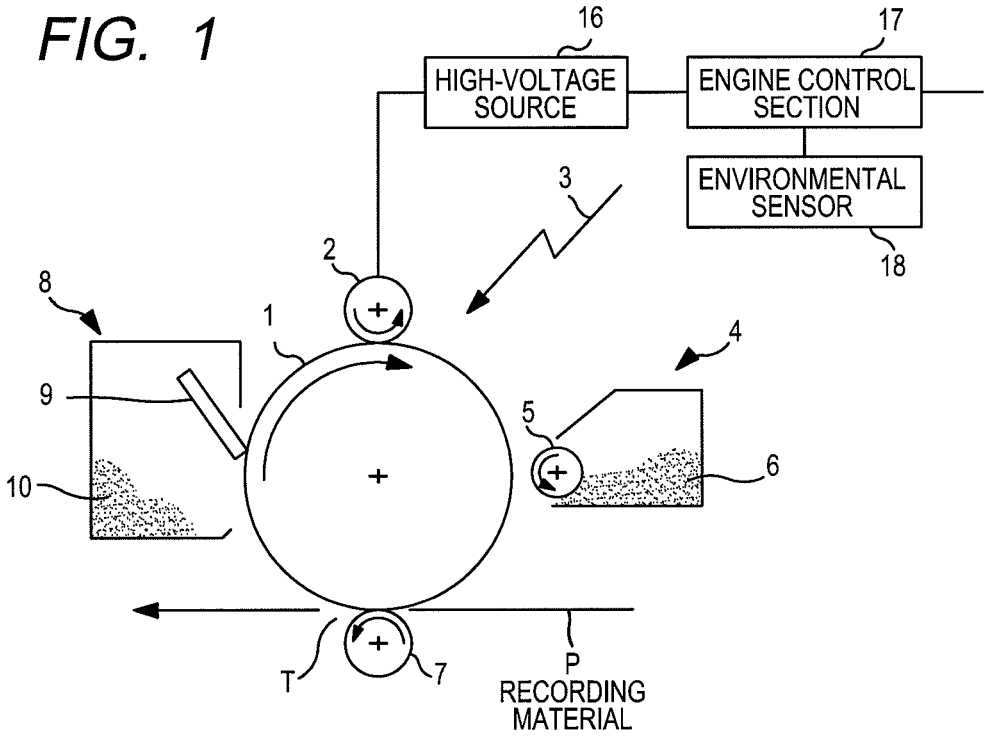
FIG. 1 is a schematic diagram illustrating a structural example of ah image forming apparatus according to an embodiment of the present invention.

FIG. 1 is a schematic diagram illustrating a structural example of an image forming apparatus. The image forming apparatus is an electrophotographic image forming apparatus of a contact charging type and a transfer type which uses a drum type electrophotographic photosensitive member (hereinafter, referred to as photosensitive drum) 1 as a rotatable image bearing member for forming an electrostatic latent image.

The photosensitive drum 1 is supported to be freely rotatable about a drum axis line and rotated by a driving mechanism (not shown) at a predetermined speed in a clockwise direction indicated by the arrow.

A surface of the rotated photosensitive drum 1 is uniformly charged to a predetermined potential with a predetermined polarity by a charging unit. In this example, the charging unit is a contact charging device (roller charging device) using a charging roller 2 as a charging member. The charging roller 2 is a conductive elastic roller having a roller shaft member (conductive base or cored bar). The charging roller 2 is rotatably supported by bearing members at both end portions of the roller shaft member and pressed to be in contact with the photosensitive drum 1 by a predetermined pressing force while a roller axis line is substantially parallel to the drum axis line of the photosensitive drum 1. In this example, the charging roller 2 is rotated according to the rotation of the photosensitive drum 1. Resin particles are mixed in a surface layer of the charging roller 2 to form an unevenness surface. The charging roller 2 is described later. Although not illustrated, the charging roller 2 is provided with a rotating brush (cleaning brush) as a cleaning member for cleaning the surface thereof. The rotating brush is rotated according to the rotation of the charging roller 2 to scrape off foreign matters deposited on the surface of the charging roller, to thereby prevent the surface of the charging roller from being locally or entirely contaminated with foreign matters.

A predetermined DC voltage generated by a high-voltage source 16 (DC charging type) or a voltage obtained by superimposing a predetermined AC voltage on the predetermined DC voltage (AC+DC charging type) is applied as a charge bias to the roller shaft member of the charging roller 2. Such control is performed by an engine control section 17. The manner of the control is changed based on environment information output from an environmental sensor 18. That is, the engine control section 17 serves as a first applied voltage determining unit associated with discharge current control, for obtaining a relationship between art applied voltage to the charging roller 2 and a discharge current amount and determining a voltage value of an applied voltage corresponding to a predetermined discharge current amount, and a second applied voltage determining unit associated with constant voltage control, for determining a voltage value of a voltage to be applied to the charging roller 2 based on the environment information detected by the environmental sensor 18. In such a structure, the surface of the rotated photosensitive drum 1 is uniformly contact-charged to a predetermined potential with a predetermined polarity. In this example, the surface of the photosensitive drum 1 is charged to a predetermined negative potential.

The charged surface of the photosensitive drum 1 is image-exposed by an image exposure unit 3. Therefore, a potential of an exposed bright area of the surface of the photosensitive drum is reduced to form an electrostatic latent image corresponding to an image exposure pattern on the surface of the photosensitive drum. The image exposure unit 3 may be an analog exposure apparatus for imaging and projection-exposing ah image of an original, or a digital exposure apparatus, for example, a laser scanner or an LED array. In this example, a laser scanner for laser scanning exposure L with a wavelength $\lambda$ of 780 mm is used as the image exposure unit 3.

The electrostatic latent image formed on the surface of the photosensitive drum as described above is developed as a toner image by a developing unit. In this example, the developing unit is a jumping reverse developing device 4 using a one-component magnetic negative chargeable toner as a developer. In the present invention, a method of using a mixture of toner particles of another developing method and magnetic carriers as a developer and carrying this developer by a magnetic force to perform development in a contact state with the photosensitive drum (two-component contact development) may be employed. Alternatively, a method of using the above-mentioned two-component developer to perform development in non-contact state with the photosensitive drum 1 (two-component non-contact development method) may be suitably employed. The developing device 4 includes a developing sleeve 5 which is rotatably driven and a hopper portion 6 for supplying a developer to the developing sleeve 5. The developing sleeve 5 and the photosensitive drum 1 are separated from each other to maintain a constant interval of 0.3 mm in a longitudinal direction of the device. The developing sleeve 5 is applied with a voltage obtained by superimposing a predetermined AG component and DC component on each other from a development bias application power supply section (not shown). Therefore, the electrostatic latent image on the surface of the photosensitive drum is subjected to jumping reverse development by the developing device 4.

A toner image formed on the surface of the photosensitive drum reaches a transferring portion T corresponding to a contact nip portion between the photosensitive drum 1 and a transferring roller 7 by the rotation of the photosensitive drum 1 and transferred to a recording material P fed to the transferring portion T. The transferring roller 7 is a conductive elastic roller having a roller shaft member (conductive base or cored bar). Both end portions of the roller shaft member are rotatably supported by bearing members. The transferring roller 7 is pressed to be in contact with the photosensitive drum 1 by a predetermined pressing force while a roller axis line is substantially parallel to the drum axis line of the photosensitive drum 1.

In this example, the transferring roller 7 is rotated according to the rotation of the photosensitive drum 1. The recording material P is fed from a sheet feeding mechanism portion (hot shown) at a predetermined control timing, introduced to the transferring portion T at a suitable timing synchronized with the image formation on the photosensitive drum 1 by a registration roller (not shown), and nipped and conveyed by the photosensitive drum 1 and the transferring roller 7. The transferring roller 7 is applied with a predetermined DC voltage of opposite polarity to the polarity of the charged toner from a transfer bias application power supply section (not shown) while the recording material P passes through the transferring portion T. In this example, the predetermined DC voltage having a positive polarity is applied. Therefore, in the transferring portion T, a rear side (a surface side opposite from a surface side facing the photosensitive drum) of the recording material P is provided with positive charges and the toner image on the surface of the photosensitive drum is sequentially and electrostatically transferred to the surface of the recording material P.

When the recording material P to which the toner image is transferred exits the transferring portion T, the recording material P is separated from the surface of the photosensitive drum 1 and introduced to a fixing device (not shown) by a conveyer belt (not shown). The fixing device is a heat fixing device including a heat roller and a pressure roller as a press-contact rotating roller pair. The recording material P introduced to the fixing device enters a fixing portion corresponding to a press-contact nip portion between the roller pair to be nipped and conveyed. Therefore, an unfixed toner image on the recording material P is fixed as a fixed image on the surface of the recording material by heat and pressure. After that, the recording material is delivered as an image formation object to the outside of the apparatus main body.

After the separation of the recording material, the surface of the photosensitive drum 1 is cleaned by removing residues such as transfer residual toners and paper dusts by a cleaning device 8. The photosensitive drum 1 with the cleaned surface is repeatedly used for image formation. In this example, the cleaning device 8 is a blade cleaning device using a chip type cleaning blade 9 as a cleaning member. The cleaning blade 9 slides on and contacts with the surface of the photosensitive drum to scrape off the residues from the surface of the photosensitive drum. The scraped-off residues 10 are contained in a recovered toner containing portion 10.

[Charging Roller]

A schematic structural example of the charging member 2 according to the embodiment of the present invention is described with reference to FIG. 2.

Figure 2:
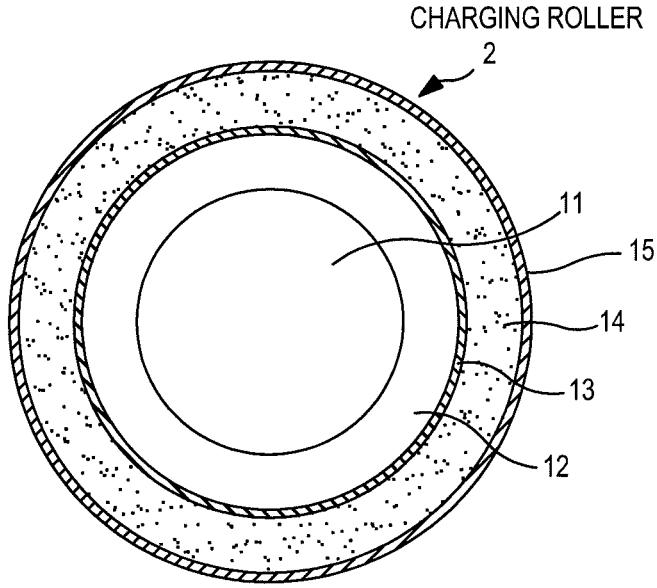
FIG. 2 illustrates a schematic structural example of a charging member according to the embodiment of the present invention.

The charging member 2 illustrated in FIG. 2 normally has a roller shape and includes a shaft member 11, a conductive elastic layer 12 formed around the shaft member 11, a softener transfer protection layer 13 formed around the conductive elastic layer 12, a resistance adjustment layer (or dielectric layer) 14 formed around the softener transfer protection layer 13, and a protective layer 15.

The shaft member 11 is not particularly limited, and hence, for example, a cored bar which is a columnar body made of metal, or a cylindrical body which is hollow and made of metal is used. Examples of the metal material include stainless steel, aluminum, copper, and plated iron.

The conductive elastic layer 12 formed around the periphery of the shaft member 11 is not particularly limited, and there are exemplified as a material for the conductive elastic layer 12 a polyurethane foam, a polynorbornene rubber, an ethylene-propylene-diene rubber (EPDM), an acrylonitrile-butadiene rubber (NBR), a hydrogenated acrylonitrile-butadiene rubber (H-NBR), a styrene-butadiene rubber (SBR), a butadiene rubber (BR), an isoprene rubber (IR), and a natural rubber (NR). Those materials may be used alone or in combination of two or more kinds thereof. A polyol component and an isocyanate component that can be used in the production of a usual polyurethane foam are particularly preferred. Examples of the above-mentioned polyol component include a polyether polyol, a polyester polyol, and a polymer polyol. Those polyol components may be used alone or in combination of two or more kinds thereof. The above-mentioned isocyanate component is not particularly limited as long as the component is a di- or more functional polyisocyanate, and examples thereof include 2,4-(or 2,6-)tolylene diisocyanate (TDI), ortho-toluidine diisocyanate (TODI), naphthylene diisocyanate (NDI), xylylene diisocyanate (XDI), 4,4'-diphenylmethane diisocyanate (MDI), carbodiimide-modified MDI, polymethylene polyphenyl isocyanate, and polymeric polyisocyanate. Those isocyanate components may be used alone or in combination of two or more kinds thereof.

It should be noted that, in addition to the above-mentioned rubbers, a foaming agent, a conductive agent, a crosslinking agent, a crosslinking promoter, an oil, and the like may be incorporated into the material for the above-mentioned conductive elastic layer 12 as required.

Examples of the above-mentioned foaming agent include inorganic foaming agents and organic foaming agents. Those foaming agents may be used alone or in combination of two or more kinds thereof.

The above-mentioned conductive agent is preferably an ionic conductive agent, and examples thereof include: cationic surfactants such as quaternary ammonium salts including perchloric acid salts, chloric acid salts, fluoroboric acid salts, sulfuric acid salts, ethosulfate salts, and benzyl halide salts (such as benzyl bromide and benzyl chloride salts) of lauryl trimethyl ammonium, stearyl trimethyl ammonium, octadodecyl trimethyl ammonium, dodecyl trimethyl ammonium, hexadecyl trimethyl ammonium, and a modified fatty acid dimethylethyl ammonium salt; anionic surfactants such as an aliphatic sulfonic acid salt, a higher alcohol sulfuric acid ester salt, a higher alcohol ethylene oxide addition sulfuric acid ester salt, a higher alcohol phosphoric acid ester salt, a higher alcohol ethylene oxide addition phosphoric acid ester salt; amphoteric surfactants such as various betaines; antistatic agents such as nonionic antistatic agents including a higher alcohol ethylene oxide, a polyethylene glycol fatty acid ester, and a polyhydric alcohol fatty acid ester; electrolytes such as salts of metals belonging to Group 1 of the periodic table including $Li^+$, $Na^+$, and $K^+$, i.e., for example, $LiCF_3SO_3$, $NaClO_4$, $LiAsF_6$, $LiBF_4$, NaSCN, KSCN, and NaCl, and quaternary ammonium salts; salts of metals belonging to Group 2 of the periodic table including $Ca^{2+}$ and $Ba^{2+}$, i.e., for example, $Ca(ClO_4)_2$; and conductive agents in each of which one of those antistatic agents has at least one group having an active hydrogen capable of reacting with an isocyanate, such as a hydroxyl group, a carboxyl group, or a primary or secondary amine group. Further examples of the conductive agent include complexes of the above-mentioned conductive agents and the like with: polyhydric alcohols such as 1,4-butandiol, ethylene glycol, polyethylene glycol, propylene glycol, and polyethylene glycol, and their derivatives; or monools such as, ethylene glycol monomethyl ether, and ethylene glycol monoethyl ether. One kind or two or more kinds selected from those conductive agents may be used. It should be noted that other known ionic conductive agents and the like may be used, and the conductive agent is not limited to the materials described above.

Alternatively, other conductive agents such as general electron conductive agents may be used. Examples thereof include: conductive carbon blacks such as ketjen black and acetylene black; carbon blacks for rubber, such as SAF, ISAF, HAF, FEF, GPF, SRF, FT, and MT; carbon blacks for ink, such as oxidized carbon black; pyrolytic carbon black; graphite; conductive metal oxides such as tin oxide, titanium oxide, and zinc oxide; metals such as nickel and copper; and conductive whiskers such as a carbon whisker, a graphite whisker, a titanium carbide whisker, a conductive potassium titanate whisker, a conductive barium titanate whisker, a conductive titanium oxide whisker, and a conductive zinc oxide whisker.

Examples of the above-mentioned crosslinking agent include sulfur and peroxides.

A conductivity of the conductive elastic layer is normally set in a range of approximately $10^{-1}\Omega$ to $10^{-4}\Omega$ and thus set to a value significantly lower than the conductivity of the resistance adjustment layer. A thickness of the conductive elastic layer is normally set in a range of approximately 1 mm to 10 mm, preferably in a range of approximately 2 mm to 4 mm.

It is particularly preferred that the softener transfer protection layer 13 formed around the conductive elastic layer 12 is a layer containing N-methoxymethylated nylon as a main component in order to block and prevent exudation of a softener including an oil contained in the conductive elastic layer. Herein, the meaning of "as a main component" includes a case where the whole consists only of the main component. A thickness of the softener transfer protection layer 13 is normally set in a range of 3 μm to 20 μm, preferably in a range of 4 μm to 10 μm. An electrical resistance of the softener transfer protection layer is set to approximately $10^{-2}\Omega$.

The N-methoxymethylated nylon (8-nylon) is not particularly limited and thus a conventionally known material is used. The softener transfer protection layer 13 contains, as a conductive agent, carbon black, for example, Ketjen black.

The resistance adjustment layer 14 formed around the softener transfer protection layer 13 is made of at least one of epichlorohydrin rubber (CHR) and acrylic rubber (ACM) and a composition containing a conductive agent as a main component. A thickness of the resistance adjustment layer 14 relates to the present invention and is required to be normally set in a range of 50 μm to 400 μm, more preferably in a range of 200 μm to 350 μm. When the thickness is smaller than 50 μm, an effect of the resistance adjustment layer 14 is too small to serve as a charging roller. When the thickness is larger than 400 μm, the effect of the resistance adjustment layer 14 is too large. Therefore, it is necessary to provide a voltage in a very high state, and hence it is difficult to use a normal power supply for an electrophotographic apparatus. Note that the epichlorohydrin rubber is one of a homopolymer and a copolymer which do not contain ethylene oxide as a copolymer component.

As described above, the at least one of CHR and ACM and the conductive agent are used to cover the softener transfer protection layer 13, and may cause charging unevenness but are essential to take advantage of charging characteristics. An electrical resistance of the resistance adjustment layer 14 is set in a range of $10^5\Omega$ to $10^8\Omega$.

The conductive agent may be one of an ion conductive agent and an electron conductive agent which are used for the resistance adjustment layer 14.

A blending amount of the conductive agent is preferably set in a range of 0.5 part to 5 parts relative to 100 parts by weight (hereinafter, referred to as "parts") of a rubber component comprising CHR and ACM. That is, when the composition amount of the conductive agent is smaller than 0.5 part, there is a very positive effect on unevenness. However, the electrical resistance cannot be adjusted, and hence it is necessary to apply an excessive voltage. When the composition amount exceeds 5 parts, the unevenness of the conductive agent causes the unevenness of the resistance, and hence image unevenness is likely to occur in the range set in the present invention.

Examples of appropriate composition materials for forming the resistance adjustment layer 14 include a vulcanizing agent and a filler in addition to the conductive agent. The vulcanizing agent is not particularly limited, and may include a known material, for example, thiourea, triazine, or sulfur. Examples of the filler include insulating fillers such as silica, talc, clay, and titanium oxide and are used alone or in combination. A conductive filler, for example, carbon black is likely to cause dielectric breakdown under a high-voltage environment, and hence the amount of use thereof is required to be limited to a value equal to or smaller than 10% by volume relative to the rubber component.

The protective layer 15 is formed as an outermost layer around the resistance adjustment layer 14 and may be a known layer used on the surface of the charging roller. To be specific, the protective layer 15 may be the layer containing N-methoxymethylated nylon as the main component as described above, a layer which may be made of a conventionally known resin, for example, a fluorocarbon resin, a urethane resin, or an acrylic resin, or a layer containing an isocyanate compound as a main component, or may be added with at least one of a conductivity-providing agent and at least one polymer selected from the group consisting of an acrylic fluorine-based polymer and an acrylic silicone-based polymer. When a conductive agent, for example, carbon black is mixed and dispersed in the protective layer, conductivity in a case of low-temperature and low-humidity is excellent and thus excellent performance is exhibited even in the low-temperature and low-humidity environment. A thickness of the protective layer 15 is set preferably in a range of 1 μm to 25 μm, more preferably in a range of 3 μm to 20 μm. An electrical resistance value of the protective layer 15 is set in a range of $10^7$ Ωcm to $10^{11}$ Ωcm. The conductive agent is not limited to carbon black and a conventionally known conductive agent may be used instead of the carbon black.

Here, examples of the isocyanate compound include 2,6-tolylene diisocyanate (TDI), 4,4'-diphenylmethane diisocyanate (MDI), para-phenylene diisocyanate (PPDI), 1,5-naphthalene diisocyanate (NDI), and 3,3-dimethyldiphenyl-4,4'-diisocyanate (TODI), and also include multimers and modified products of the isocyanate compounds described above.

In addition, the acrylic fluorine-based polymer and the acrylic silicone-based polymer are ones each of which is soluble in a given solvent and capable of reacting, with an isocyanate compound to form a chemical bond. The acrylic fluorine-based polymer is, for example, a solvent-soluble, fluorine-based polymer which has a hydroxyl group, ah alkyl group, or a carboxyl group. Examples thereof include a block copolymer of an acrylic acid ester and a fluoroalkyl acrylate, and its derivatives. In addition, the acrylic silicone-based polymer is a solvent-soluble, silicone-based polymer, and examples thereof include a block copolymer of an acrylic acid ester and an acrylic acid siloxane ester, and its derivatives.

When a conductive agent, for example, carbon black is mixed and dispersed in the protective layer 15, environmental characteristics including conductivity in a case of low-temperature and low-humidity are excellent and thus excellent performance is exhibited even in the low-temperature and low-humidity environment. A thickness of the protective layer 15 is normally set preferably in a range of 5 μm to 30 μm, more preferably in a range of 7 μm to 23 μm. An electrical resistance value of the protective layer is set in a range of $10^3\Omega$ to $10^5\Omega$. The conductive agent is not limited to carbon black and a conventionally known conductive agent may be used instead of the carbon black.

For example, the charging roller 2 in the present invention may be produced as follows. That is, an adhesive agent is applied to an outer circumference surface of a cored bar 11 and the conductive elastic layer 12 is formed by mold vulcanization using the rubber composition described above. A mixed resin liquid in which N-methoxymethylated nylon is mixed with a conductive agent is prepared in advance. A surface of the conductive elastic layer 12 is polished if necessary, and then subjected to coating the mixed resin liquid by spraying or dipping and dried. If necessary, thermal treatment is performed for cross linking to form the softener transfer protection layer. The resistance adjustment layer 14 is formed on the softener transfer protection layer 13 containing the conductive agent. The resistance adjustment layer 14 may be formed as follows. The at least one of CHR and ACM and the ion conductive agent are kneaded with a reinforcing agent, a processing aid, a vulcanizing agent, and a filler by a normal rubber processing method (Banbury mixer or roll) to obtain an unvulcanized rubber composition. The unvulcanized rubber composition is dissolved in a suitable solvent (for example, methyl ethyl ketone or methyl isobutyl ketone), applied to an outer circumference surface of the conductive elastic layer and then dried, and vulcanized by heating. A dip method is preferred for the application. The dip method is a method of performing dipping in a dip solution and drying while a film thickness is controlled based on a drawing speed. Next, a roll on which the conductive elastic layer 12 is formed is repeatedly immersed by the dip method to form a rubber film containing the conductive agent as the main component on the outer circumference surface of the conductive elastic layer 12. In this case, it is preferred that conditions such as viscosity of the dip solution, an up-and-down speed, the number of up-and-down movements, and a dry time period be set so that a thickness of a liquid film of the solution containing the conductive agent as the main component is in a range of 50 μm to 400 μm when dried. The roll with the formed liquid film is dried at a temperature in a range of 25° C. to 80° C. for 0.5 hours to 4 hours to remove the solvent, and subsequently heated at a temperature in a range of 150° C. to 200° C. for 10 minutes to 2 hours to vulcanize the rubber film containing the conductive agent component as the main component, to thereby obtain the resistance adjustment layer. Next, the resistance adjustment layer 14 formed as described above is coated by spraying or dipping with a resin liquid containing fluororesin or the resin liquid mixed with a conductive agent in some cases, and then dried. If necessary, thermal treatment is performed for cross linking to form the protective layer. Therefore, the layer structure as illustrated in FIG. 2 may be obtained. The layer structure is a preferred structure, and a four or more-layer structure may be formed by repeating application and drying. A three-layer structure in which the protective layer (outermost layer) and the resistance adjustment layer are integrally formed or a two-layer structure in which the softener transfer protection layer is further integrally formed therewith may be applied. A two-layer structure may be applied in which the conductive elastic layer 12, the resistance adjustment layer 14, and the softener transfer protection layer 13 are integrally formed and coated with only the protective layer 15.

A total electrical resistance of the obtained charging roller 2 is set in a range of approximately $10^3\Omega$ to $10^8\Omega$. As described above, the electrical resistance is largely determined based on conductive agent amounts of the resistance adjustment layer 14 and the protective layer 15. In view of film thickness, the electrical resistance is substantially determined based on the conductive agent amount of the resistance adjustment layer 14. However, the present invention is not limited to this.

The resistance value of the charging roller according to the present invention is measured as follows. The photosensitive drum of the image forming apparatus is exchanged for a drum made of aluminum. After that, a voltage of 100V is applied between the drum made of aluminum and the cored bar 11 of the charging roller 2 and a value of current flowing therebetween is measured to obtain the resistance value of the charging roller 2.

[Photosensitive Member]

Next, general matters of the image bearing member (photosensitive member) 1 according to the present invention are described below. The long life of the photosensitive member is intended. However, the present invention is not limited to this and a surface protective layer 56 may be omitted.

A feature (example) of the surface protective layer intended for the long life of the photosensitive member according to the embodiment of the present invention is briefly described first. A universal hardness value (HU) and elastic deformation ratio of the surface protective layer 56 are measured using a microhardness measuring apparatus (Fischer scope H100V produced by Fischer) in which an indentation depth with respect to a load is directly read to continuously obtain hardness while the load is continuously imposed on an indenter. The used indenter is a Vickers quadrangular pyramid diamond indenter having an opposite face angle of 136°. With respect to a load condition, a final load is 6 mN. The measurement is performed stepwise at 273 points for each retaining time period of 0.1 seconds.

Figure 3:
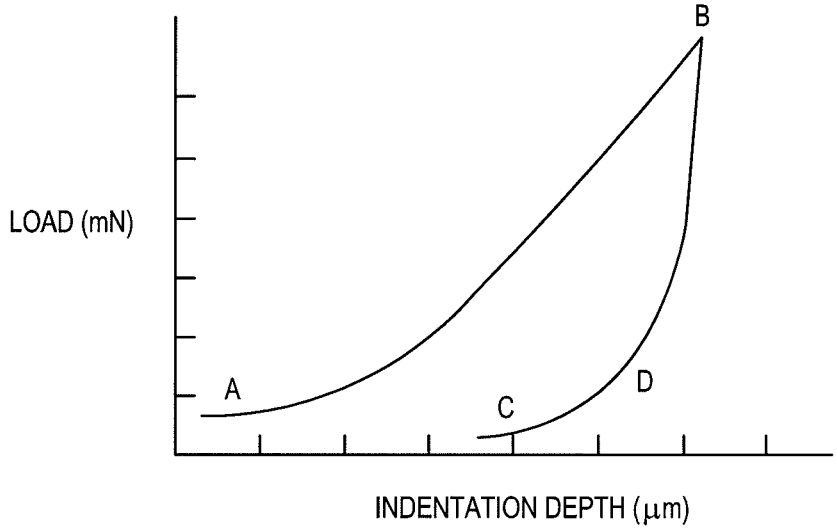
FIG. 3 is a graph illustrating an output of a Fischer scope H100V (produced by H. Fischer).

FIG. 3 is a schematic graph illustrating an output of the Fischer scope H100V (produced by H. Fishere). In the graph, the ordinate indicates the load (mN) and the abscissa indicates an indentation depth h (μm). The graph exhibits a result obtained in a case where the load is increased stepwise to 6 mN and then reduced stepwise in the same manner. The universal hardness value (hereinafter, referred to as HU) is defined by Expression (1) described below based on an indentation depth obtained when the load is imposed at 6 mN.

$$HU=(\text{test load (N)})/(\text{surface area of Vickers indenter under test load (mm}^2))=0.006/26.43\,h^2\ (\text{N/mm}^2) \quad (1)$$

where h indicates an indentation depth under the test load (mm).

The elastic deformation ratio is obtained from a work (energy) of the indenter acting on a film, that is, a change in energy due to an increase or reduction in load of the indenter to the film, and calculated by the following expression. A total work Wt (nW) is expressed by an area surrounded by A-B-D-A illustrated in FIG. 3 and an elastic deformation work We (nW) is expressed by an area surrounded by C-B-D-C.

$$(\text{Elastic Deformation Ratio})=We/Wt\times 100(\%)$$

As described above, an example of performance required for the organic electrophotographic photosensitive member includes improved durability with respect to mechanical degradation. It is generally expected that film hardness is high when a deformation amount which is caused by an external force is small, and thus the durability of the electrophotographic photosensitive member with respect to mechanical degradation seems to improve with an increase in pencil hardness or Vickers hardness. However, even when hardness obtained by the measurement is high, the durability is not necessarily improved.

As a result of intensive studies, the inventors of the present invention found that the surface layer of the photosensitive member is resistant to mechanical degradation in a case where the HU value and the elastic deformation ratio value are in certain ranges. That is, when a hardness test is performed using the Vickers quadrangular pyramid diamond indenter and an electrophotographic photosensitive member in which a HU in a case of indentation at a maximum load of 6 mN is equal to or larger than 150 $N/mm^2$ and equal to or smaller than 220 $N/mm^2$ and an elastic deformation ratio is equal to or larger than 40% and equal to or smaller than 65% is provided, the characteristic was significantly improved. In order to further improve the characteristic, the HU value is more preferably equal to or larger than 160 $N/mm^2$ and equal to or smaller than 200 $N/mm^2$.

The HU and the elastic deformation ratio cannot be separately considered. However, for example, in a case that the HU exceeds 220 $N/mm^2$, when the elastic deformation ratio is smaller than 40%, an elastic force of the photosensitive member is insufficient, and when the elastic deformation ratio is larger than 65%, even if the elastic deformation ratio is large, an elastic deformation amount becomes small. As a result, a large force is locally applied, and hence a deep defect occurs because of paper dusts and toners which are caught by the cleaning blade and the charging roller. Thus, it is expected that a photosensitive member having a high HU is not necessarily optimum.

In a case where the HU is smaller than 150 $N/mm^2$ and the elastic deformation ratio exceeds 65%, even when the elastic deformation ratio increases, a plastic deformation amount also becomes larger. Therefore, shaving or minute scratching occurs because of rubbing with paper dusts and toners which are caught by the cleaning blade and the charging roller.

Considering the long life of the photosensitive drum 1 used in the present invention, at least the surface layer of the electrophotographic photosensitive member contains a compound cured by one of polymerization and cross linking. Heat, light (visible light or ultraviolet light), and radiation may be used for a curing method.

Therefore, in this embodiment, the following method is employed as a method of forming the surface layer of the photosensitive member. A compound, which is used for the surface layer and may be cured by one of polymerization and cross linking, is melted or contained in an application solution, and the application solution is used and applied by one of a dip coating method, a spray coating method, a curtain coating method, and a spin coating method. After that, the applied compound is cured by the curing method.

The dip coating method is most preferred as a method for efficiently mass-producing photosensitive members. In this embodiment, the dip coating method may be employed. This surface protective layer is intended for the long life and thus the present invention is not limited to this.

Figure 4A:
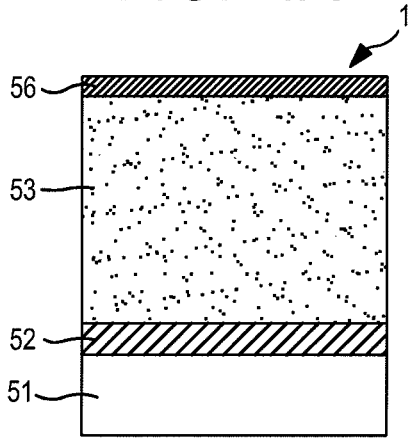
FIGS. 4A and 4B illustrate schematic structural examples of a photosensitive drum according to the embodiment of the present invention.
Figure 4B:
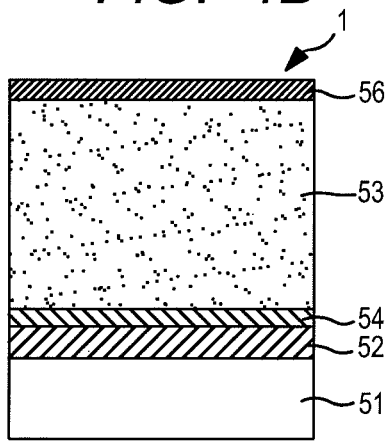

A schematic structure of the photosensitive drum in this embodiment is described with reference to FIGS. 4A and 4B. Above a conductive support member 51 having an outer diameter of, for example, 30 mm, a layer structure of a single-layer type in which a layer 53 containing both a charge generation substance and a charge transport substance (FIG. 4A) is provided, or a layer structure of a laminate type in which a charge generation layer 54 containing a charge generation substance and a charge transport layer 55 containing a charge transport substance are laminated in this order or reverse order (FIG. 4B) is provided. A surface protective layer 56 may be formed on the photosensitive layer.

In this embodiment, in order to optimize a film thickness of an electron transport layer, the surface protective layer 56 is desirably used in view of film thickness margin. At least the surface layer of the photosensitive member may contain a compound which may be cured by one of polymerization and cross linking with one of heat, light (visible light or ultraviolet light), and radiation. In view of the characteristics of the photosensitive member, in particular, electrical characteristics including a residual potential and durability, a preferred structure is one of a function separation type photosensitive member structure in which the charge generation layer and the charge transport layer are laminated in order, and a structure in which the surface protective layer is further formed on the photosensitive layer laminated in the function separation type photosensitive member structure (FIG. 4B).

In this embodiment, it is preferred that radiation be used for the method of curing the compound of the surface layer by one of polymerization and cross linking because the radiation less degrades the characteristics of the photosensitive member and does not increase the residual potential, and sufficient hardness may be exhibited.

Desired examples of the radiation used to cause one of polymerization and cross linking include an electron beam and a gamma ray. When the electron beam is used, any type of accelerator, including a scanning type, an electron curtain type, a broad beam type, a pulse type, and a laminar type, may be used.

In a case of electron beam irradiation, in order to exhibit the electrical characteristic and durability performance of the photosensitive member in this embodiment, an accelerating voltage of irradiation conditions is set to preferably a value equal to or smaller than 250 kV, more preferably a value equal to or smaller than 150 kV. An exposure dose is set to preferably a value equal to or larger than 10 kJ/kg and equal to or smaller than 1,000 kJ/kg, more preferably a value equal to or larger than 15 kJ/kg and equal to of smaller than 500 kJ/kg.

When the accelerating voltage is larger than an upper limit of the range described above, the degradation of the characteristics of the photosensitive member which is caused by the electron beam irradiation, so-called damage thereof, is likely to increase. When the exposure dose is smaller than a lower limit of the range described above, curing is more likely to become insufficient. When the exposure dose is large, the characteristics of the photosensitive member are more likely to degrade, and hence the dose is desirably selected from the range described above.

Preferred examples of the compound which is used for the surface layer and may be cured by one of polymerization and cross linking include compounds containing unsaturated polymerizable functional groups in the molecules in view of high reactivity, a high reaction speed, and high hardness achieved after curing.

Of the compounds containing unsaturated polymerizable functional groups in the molecules, it is preferred that a compound containing an acrylic group, a methacrylic group, and a styrene group be used.

In this embodiment, the compounds containing the unsaturated polymerizable functional groups are broadly divided into a monomer and an oligomer in view of a repeated state of constituent units. With respect to the monomer, constituent units including the unsaturated polymerizable functional groups are not repeated and a molecular weight is relatively small. In contrast to this, the oligomer is a polymer in which the number of repetitions of the constituent units including the unsaturated polymerizable functional groups is approximately 2 to 20. A so-called macromonomer in which the unsaturated polymerizable functional groups are bonded to only ends of one of the polymer and oligomer may be used as the curable compound for surface layer in this embodiment.

It is more preferred that the compound containing the unsaturated polymerizable functional groups in this embodiment employ a charge transport compound in order to satisfy a charge transport function required for the surface layer. It is further preferred that the charge transport compound be an unsaturated polymerizable compound having a hole transport function.

Next, the photosensitive layer of the photosensitive drum 1 in this embodiment is described.

The support member 51 of the photosensitive drum 1 has only to be conductive, and specific examples thereof include: a product obtained by forming a metal such as aluminum, copper, chromium, nickel, zinc, or stainless steel, or an alloy thereof into a form of drum or sheet; a product obtained by laminating a metal foil of, for example, aluminum or copper on a plastic film; a product obtained by depositing, for example, aluminum, indium oxide, or tin oxide from the vapor on a plastic film; and a metal, a plastic film, or paper each of which is provided with a conductive layer by applying a conductive substance alone or together with a binder resin.

In this embodiment, an undercoat layer 52 having a barrier function and a bonding function may be provided on a surface of the conductive support member 51.

The undercoat layer 52 is formed to achieve the improvement of bonding of the photosensitive layer, the improvement of coating, the protection of the support member, the coating of defect on the support member, the improvement of charge injection from the support member, and the protection of the photosensitive layer from electrical break.

In the material of the undercoat layer 52, there may be used polyvinyl alcohol, poly-N-vinylimidazole, polyethylene oxide, ethyl cellulose, an ethylene-acrylic acid copolymer, casein, a polyamide, N-methoxymethylated 6-nylon, copolymerized nylon, glue, gelatin, or the like. Those materials are each dissolved in a compatible solvent to be applied on the surface of the support member. The undercoat layer suitably has a film thickness of 0.1 μm to 2 μm.

When the photosensitive member of the present invention is a photosensitive member of a function separating type, the charge generation layer 54 and the charge transport layer 55 are laminated. Examples of a charge generation substance to be used for the charge generation layer 54 include selenium-tellurium (Se—Te), pyrylium, thiapyrylium-based dyes, and phthalocyanine-based compounds having various central metals and crystal systems, specifically crystal types such as α-, β-, γ-, ∈-, and X-types, anthanthrone pigments, dibenzpyrenequinone pigments, pyranthrone pigments, trisazo pigments, disazo pigments, monoazo pigments, indigo pigments, quinacridone pigments, asymmetric quinocyanine pigments, quinocyanine, and amorphous silicon.

In addition, in the case of the photosensitive member of a function separating type, the charge generation layer 54 is formed by dispersing favorably a charge generation substance together with a binder resin in an amount 0.3 to 4 times that of the charge generation substance, and a solvent by means of, for example, a homogenizer, ultrasonic dispersion, a ball mill, a vibration ball mill, a sand mill, an attritor, or a roll mill, applying the resultant dispersion liquid, and drying the applied dispersion liquid. Alternatively, the layer is formed as a film of a single component, such as a film obtained by depositing a charge generation substance from the vapor. Here, the charge generation layer 54 has a film thickness of typically 5 μm or less, suitably 0.1 μm to 2 μm.

In addition, examples of the binder resin to be used include: polymers and copolymers of vinyl compounds such as styrene, vinyl acetate, vinyl chloride, an acrylic acid ester, a methacrylic acid ester, vinylidene fluoride, and trifluoroethylene; polyvinyl alcohols; polyvinyl acetals; polycarbonates; polyesters; polysulfones; polyphenylene oxide; polyurethanes; cellulose resins; phenolic resins; melamine resins; silicone resins; and epoxy resins.

The hole transport compound containing the unsaturated polymerization functional group in this embodiment may be used as the charge transport layer 55 on the charge generation layer 54. The charge transport layer 55 including the binder resin may be formed on the charge generation layer 54 and then may be used as the surface protective layer 56.

When the hole transport compound is used for the surface protective layer 56, the undercoat electron transport layer may be formed by applying the following solution by the known method described above, and drying the applied solution. The solution is obtained by dispersing or dissolving in a solvent together with an appropriate binder resin, which may be selected from the resins for the charge generation layer described above, an appropriate charge transport substance such as: a high-molecular compound having a heterocycle or a fused polycyclic aromatic structure, such as poly-N-vinyl carbazole or polystyrylanthracene; a heterocyclic compound such as pyrazoline, imidazole, oxazole, triazole, or carbazole; or a low-molecular compound such as a triarylamine derivative, e.g., triphenylamine, a phenylenediamine derivative, an N-phenylcarbazole derivative, a stilbene derivative, or a hydrazone derivative.

In this case, with respect to a ratio between the charge transport substance and the binder resin, when a total weight of both is assumed to be 100, a weight of the charge transport substance is desirably in a range of 30 to 100, more preferably selected as appropriate in a range of 50 to 100.

When the weight of the charge transport substance in the charge transport layer 55 is outside the ranges, the charge transport performance reduces, and hence a problem that sensitivity reduces or the residual potential increases occurs. In this case, the thickness of the charge transport layer 55 in the present invention is in a range of 10 μm to 30 μm.

In any case, with respect to a general surface layer forming method, a solution containing the hole transport compound is applied and then subjected to polymerization or curing reaction. The solution containing the hole transport compound may be reacted in advance to obtain a hardened material and then a solution in which the hole transport compound is dispersed or dissolved in a solvent again may be used to form the surface layer.

Known examples of the solution application method described, above include a dip coating method, a spray coating method, a curtain coating method, and a spin coating method. In view of efficiency and productivity, the solution application method is desirably the dip coating method. Other known film formation methods such as evaporation and plasma processing may be selected as appropriate.

In this embodiment, conductive particles may be mixed into the surface protective layer 56. Examples of the conductive particles may include metal, metal oxide, and carbon black.

Specific examples of the metal as the conductive particles may include aluminum, zinc, copper, chromium, nickel, stainless steel, and silver. An example of the conductive particles may include plastic particles in which one of the metals is deposited on a surface thereof from the vapor.

Specific examples of the metal oxide as the conductive particles may include zinc oxide, titanium oxide, tin oxide, antimony oxide, indium oxide, bismuth oxide, tin-doped indium oxide, antimony-doped tin oxide, and antimony-doped zirconium oxide.

The metal oxides may be used alone or in combination of two or more types. When at least two types are combined, mixing may be merely performed or a solid solution or fusion may be applied.

An average particle diameter of the conductive particles used in this embodiment is set to preferably a value equal to or smaller than 0.3 μm in view of transparency of the surface protective layer 56, more preferably a value equal to or smaller than 0.1 μm. In this embodiment, it is particularly preferred that metal oxide be used as the material of the conductive particles in view of transparency.

A ratio of conductive metal oxide particles in the surface protective layer 56 is one of factors for directly determining the resistance of the surface protective layer. Therefore, the resistivity of the surface protective layer is desirably set in a range of $10^8$ Ωm to $10^{13}$ Ωm ($10^{10}$ Ωcm to $10^{15}$ Ωcm).

In this embodiment, fluorine atom-contained resin particles may be included in the surface layer. It is preferred that the fluorine atom-contained resin particles be at least one selected from the group consisting of a tetrafluoroethylene resin, a chlorotrifluoroethylene resin, a hexafluoroethylene-propylene resin, a vinyl fluoride resin, a vinylidene fluoride resin, a dichlorodifluoroethylene resin, and copolymers of those polymers. A molecular weight and particle diameter of the resin particles may be selected as appropriate and thus are not necessarily limited to the molecular weight and particle diameter described above.

A ratio of the fluorine atom-contained resin particles in the surface layer to a total mass of the surface layer is typically in a range of 5% by weight to 40% by weight, more preferably in a range of 10% by weight to 30% by weight. The reason is as follows. When the ratio of the fluorine atom-contained resin particles is larger than 40% by weight, a mechanical strength of the surface layer is more likely to reduce. When the ratio of the fluorine atom-contained resin particles is smaller than 5% by weight, the mold release of the surface of the surface layer and the abrasion resistance and scratching resistance of the surface layer are likely to become insufficient.

In this embodiment, in order to further improve dispersion, binding, and weathering resistance, an additive, for example, a radical scavenger or an antioxidant may be added into the surface layer. In this embodiment, the film thickness of the surface protective layer is preferably in a range of 0.2 μm to 10 μm, more preferably in a range of 0.5 μm to 6 μm.

[Discharge Current Amount]

Figure 5:
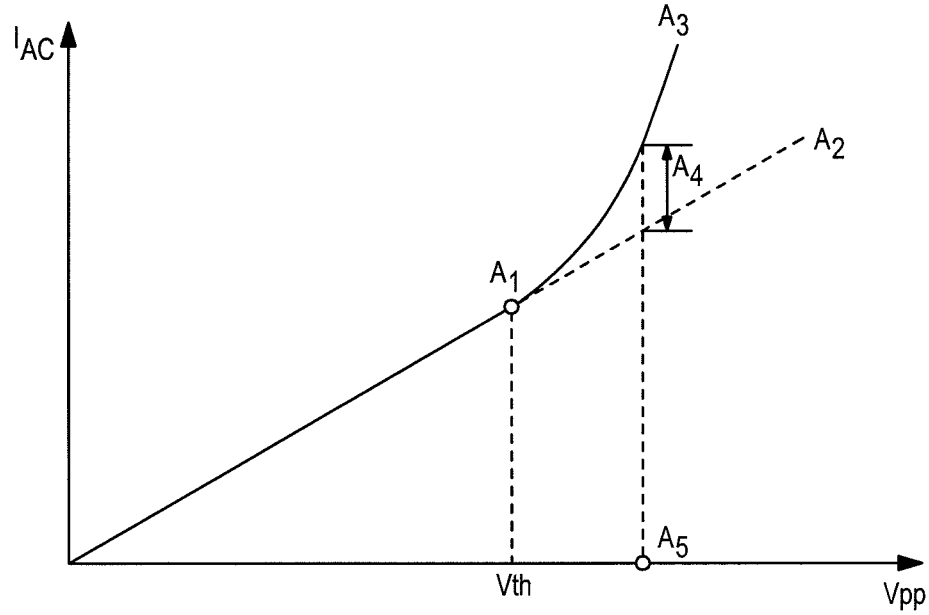
FIG. 5 is a graph illustrating a discharge current amount according to the embodiment of the present invention.

A discharge current amount in the present invention is described with reference to FIG. 5. In a general electrophotographic apparatus, the DC voltage and the AC voltage are applied to the charging roller in order to obtain the uniformity of charging and prevent the unevenness of image. In the present invention, the "discharge current amount" relates to a discharge characteristic based on a current amount curve with respect to the AG voltage (Vpp) applied to mainly the charging roller, and is a current amount during the discharging. In general, when the peak-to-peak voltage Vpp of the AC voltage applied to the charging roller (abscissa in graph) is increased and an AC current amount (Iac) is measured on the support member side of the photosensitive member, a relationship between Vpp and Iac as illustrated in FIG. 5 is obtained. As is apparent from the graph, while Vpp is small, Iac linearly increases with an increase in Vpp. However, after Vpp reaches a point A1 corresponding to a predetermined threshold value Vth (discharge start point), a voltage-current relationship changes. That is, when Vpp exceeds the point A1, the current amount Iac increases beyond the linear relationship. An increased component A4 is considered to be caused by the discharge current.

Therefore, the discharge current amount corresponds to a current difference A4 at Vpp (A5) in a discharge region defined between a directly proportional line A2 (broken line) obtained by plotting points lower than the discharge start point A1 and an actually flowing current curve A3 (solid line).

[Discharge Current Control]

Figure 6:
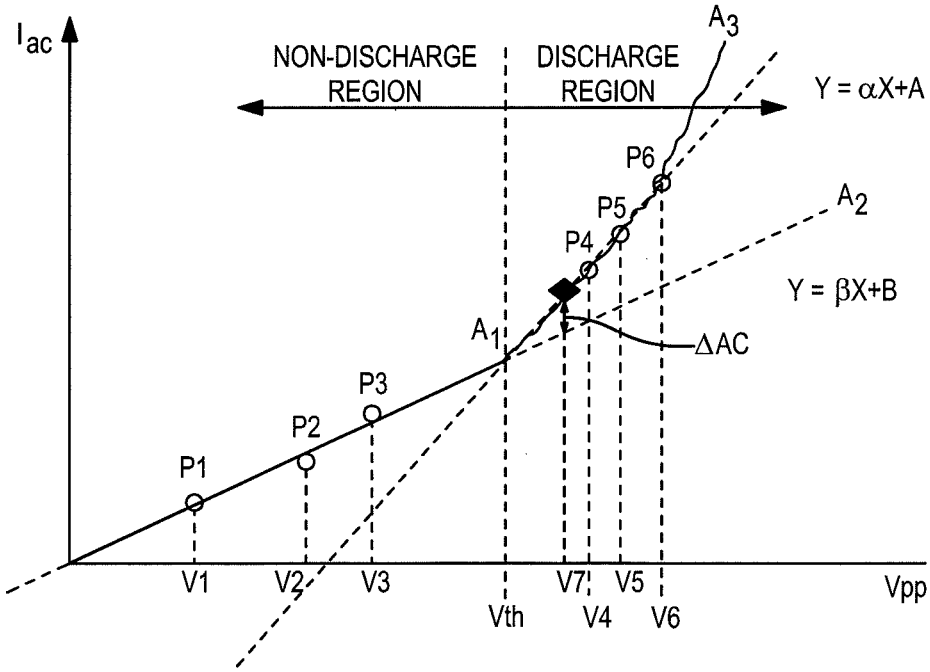
FIG. 6 is a graph illustrating discharge current control according to the embodiment of the present invention.

The discharge current control is a method of calculating a value of Vpp with which a predetermined discharge current amount is obtained, from an approximate line in order to obtain the discharge current amount described above. To be specific, as illustrated in FIG. 6, three Vpp values V1, V2, and V3 of an AC voltage in a non-discharge region are sequentially applied to the charging roller 2, and then three Vpp values V4, V5, and V6 of an AC voltage in a discharge region are sequentially applied thereto.

Among values P1, P2, P3, P4, P5, and P6 of the total current amount Iac flowing at the Vpp values of the respective AC voltages, the three values P1, P2, and P3 in the non-discharge region are used to provide an expression exhibiting an approximate line based on the method of least squares as Expression (2) described below.

$$\text{Approximate line in non-discharge region: } Y=\beta X+B \quad (2)$$

The three values P4, P5, and P6 in the discharge region are used to provide an expression exhibiting an approximate line based on the method of least squares as Expression (3) described below.

$$\text{Approximate line in discharge region: } Y=\alpha X+A \quad (3)$$

A discharge current amount ΔAC is obtained from a difference between Expression (3) and Expression (2). To be specific, a peak-to-peak voltage Vx with which the discharge current amount is D is determined by the following expression based on the difference between the approximate line in the discharge region which is exhibited by Expression (3) and the approximate line in the non-discharge region which is exhibited by Expression (2). That is, when a Y-value of Expression (2) and a Y-value of Expression (3) with respect to Vx are denoted by Yβ and Yα, respectively, and substituted into Expressions (2) and (3), Expressions (2)' and (3)' described below are obtained.

$$Y\beta=\beta Vx+B \quad (2)'$$

$$Y\alpha=\alpha Vx+A \quad (3)'$$

Therefore, Vx is obtained by the following expression from Expressions (2)' and (3)'.

$$Vx=(D-A+B)/(\alpha-\beta) \quad (4)$$

(where D=Yα−Yβ)

The peak-to-peak voltage Vpp to be applied to the charging roller 2 is changed to Vx obtained, by Expression (4) described above and control is shifted to a printing process.

When a necessary discharge current amount D (ΔAC) is provided, a target Vpp value V7 may be found. The target Vpp value is fed back to the engine control section to perform the charge control. In this case, V7 is required to satisfy a relationship of V1<V2<V3<V7<V4<V5<V6. If the relationship is not satisfied, a difference between the actual discharge current amount A4 and the necessary discharge current amount ΔAC is large, and hence an error occurs.

Figure 7:
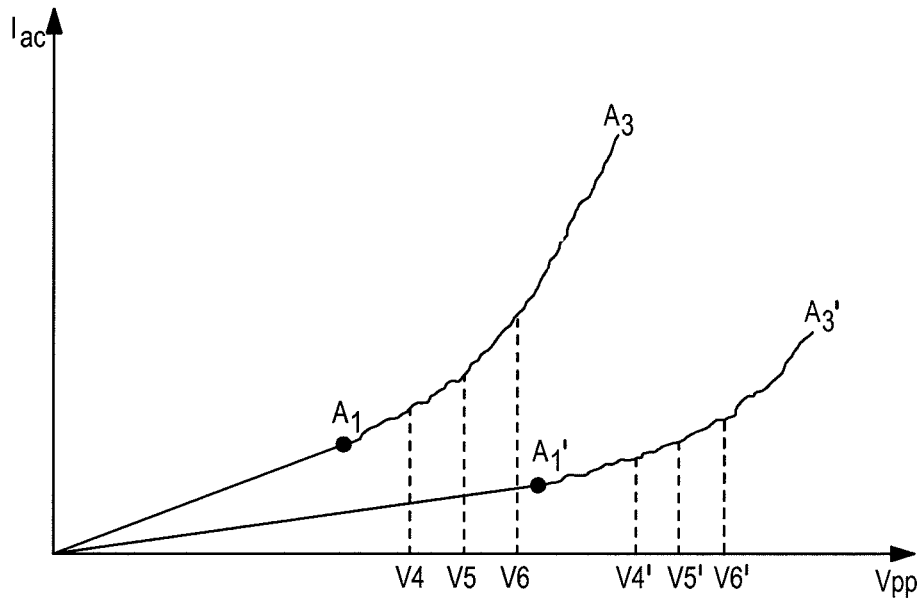
FIG. 7 is a graph illustrating a problem of the discharge current control in a low-temperature environment.

In this case, as illustrated in FIG. 7, discharging is difficult in a low-temperature environment, and hence a discharge current curve A3 is shifted to, for example, a curve A3'. Therefore, as compared with a case of a high-temperature environment, a discharge start point A1' is shifted as well. As a result, voltage values V4', V5', and V6' for discharge current control are required to be applied in a high-voltage region.

Although described later in detail, it was experimentally confirmed that, a relationship among the voltage values V4, V5, and V6 needed to satisfy a condition of 1.934<(V4+V6)/V5<1.993 under a relationship of V4<V5<V6 in view of discharge characteristics and discharge current amounts. When 1.993≤(V4+V6)/V5 is satisfied, a gradient is too large and overdischarging occurs, and hence an image becomes defective. When (V4+V6)/V5≤1.934 is satisfied, an error to an actual discharge current amount is too large and the discharge current is estimated to be smaller than actual, resulting in poor charging.

[Constant Voltage Control]

The constant voltage control is a method of stably controlling a charge voltage for charge control to a desired voltage value. The following control operation is performed. When the engine control section sets a fixed PWM value to apply a voltage, an output voltage is monitored through a resistor and the monitored voltage is fed back to a voltage set circuit section to control so that an output voltage value corresponds to a set value of a set PWM signal.

[Environmental Sensor]

The environmental sensor serving as an environment detection unit is a generic name for sensors for detecting set environments such as a temperature, humidity, and a specific gas concentration. In this embodiment, the environmental sensor corresponds to a humidity sensor or a temperature sensor. The temperature sensor is generally a thermistor for measuring a temperature of air. The humidity sensor is generally a sensor for measuring humidity of air based on a change in capacitance. An output of each of the sensors is an electrical signal. (Various commercial environmental sensors are produced by respective companies. In this example, the environmental sensor is HSU-01F1V2-N produced by Hokuriku Electric Industry Co., Ltd.)

EXAMPLES

Hereinafter, the present invention is specifically described with reference to examples and comparative examples. The present invention is not limited to the following examples.

Example 1

[Preparation of Conductive Elastic Layer Forming Material]

A rubber composition was prepared using respective components described below as conductive elastic layer forming materials.

| | |
|---|---|
| Polynorbornene rubber | 100 parts |
| Ketjen black | 50 parts |
| Napthenic oil | 400 parts |

[Preparation of Softener Transfer Protection Layer Forming Material]

A carbon black dispersion resin liquid was prepared using respective components described below as softener transfer protection layer forming materials.

| | |
|---|---|
| N-methoxymethylated nylon | 100 parts |
| Carbon black | 15 parts |

[Preparation of Resistance Adjustment Layer Forming Material]

A resistance adjustment layer forming material was prepared using respective components as described below.

CHR 100 parts

Quaternary ammonium salt 1 part

[Preparation of Protective Layer Forming Material]

A resin liquid was prepared using respective components described below as protective layer forming materials.

| | |
|---|---|
| N-methoxymethylated nylon | 100 parts |
| Carbon black | 8 parts |

Next, a bonding material was applied to an outer circumference of a cored bar including a shaft which has a diameter of 8 mm and is made of metal. After that, the rubber composition of the conductive elastic layer forming material was used, and a conductive elastic layer was formed on the outer circumference by mold vulcanization so that a total diameter was 15 mm. Next, an outer circumference of the conductive elastic layer was coated by spraying with the carbon black dispersion resin liquid of the softener transfer protection layer forming material, and then dried to form a softener transfer protection layer which had a thickness in a range of 6 μm to 10 μm. In contrast to this, a rubber composition for forming the resistance adjustment layer was roll-kneaded, and then dissolved in a solvent of (methyl ethyl ketone)/(methyl isobutyl ketone)=3/1 (weight ratio)). Viscosity was adjusted to 500 centipoises to produce a dip liquid. The cored bar provided with the softener transfer protection layer in a manner described above was immersed in the dip liquid for coating, then pulled and dried, and subjected to thermal treatment for cross linking. In this case, the thickness of the resistance adjustment layer was adjusted to 200 μm when dried. After that, the surface of the resistance adjustment layer was coated by spraying with the resin liquid for forming the protective layer, and then dried to form the protective layer. As a result, a target conductive roll was obtained. In this case, an outer diameter of the charging roller was 16 mm and a total resistance thereof was $1\times10^6\Omega$ (applied voltage is 100 V).

Next, the photosensitive drum 1 was produced as follows. A coating for conductive layer was prepared for an aluminum cylinder of 30ϕ (thrust length is 360 mm) in the following manner. 50 parts (weight parts, the same applies hereinafter) of conductive titanium oxide fine particles coated with tin oxide containing 10% antimony oxide, 25 parts of phenol resin, 20 parts of methyl cellosolve, 5 parts of methanol, and 0.002 parts of silicone oil (polydimethylsiloxane polyoxyalkylene copolymer, average molecular weight is 3,000) were dispersed for two hours by a sand mill apparatus using glass beads having ϕ1 mm and were prepared. The coating was applied onto the cylinder by a dip application method and dried at 140° C. for 30 minutes to form a conductive layer having a film thickness of 20 μm.

Next, 5 parts of N-methoxymethylated nylon were dissolved in 95 parts of methanol to prepare a coating for intermediate layer. The coating was applied onto the conductive layer described above by a dip coating method, and dried at 100° C. for 20 minutes to form an intermediate layer having a film thickness of 0.6 μm.

Next, 3 parts of oxytitanium phthalocyanine exhibiting strong peaks at Bragg angles 2θ+0.2° of 9.0°, 14.2°, 23.9°, and 27.1° in the X-ray diffraction of CuKα, 3 parts of polyvinylbutyral (product name is S-LEC BM-2, produced by Sekisui Chemical Co., Ltd.), and 35 parts of cyclohexanone were dispersed for two hours by a sand mill apparatus using glass beads having a diameter of φ1 mm, and then added with 60 parts of ethyl acetate to prepare a coating for charge generation layer. The coating was applied onto the intermediate layer by a dip application method and dried at 50° C. for 10 minutes to form a charge generation layer having a film thickness of 0.2 μm.

Next, after the formation of the charge generation layer, 10 parts of a styryl compound represented by Structural Formula (5) described below:

[Chem. 1]

(5)

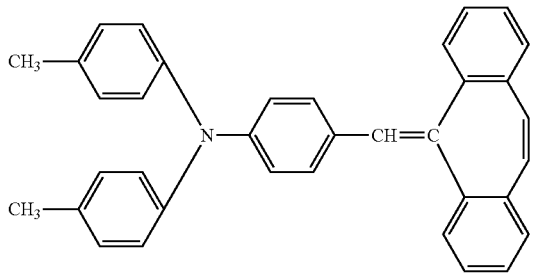

and 10 parts of a polycarbonate resin having a repeating unit as represented by Structural Formula (6) described below:

[Chem. 2]

(6)

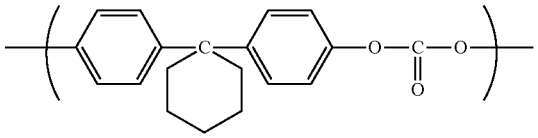

(Mv ⇌ 20000)

were dissolved in a mixture solvent including 50 parts of monochlorobenzene and 30 parts of dichloromethane to prepare an application liquid for charge transport layer. The application liquid was applied onto the charge generation layer by dip coating, and dried at 120° C. for one hour to form a charge transport layer having a film thickness of 20 μm.

[Chem. 3]

(7)

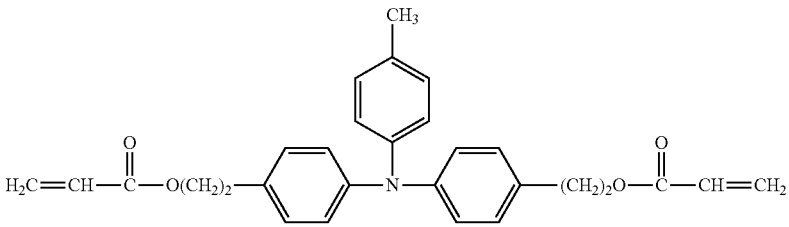

Next, 60 parts of hole transport compound represented by Structural Formula (7) were dissolved in a mixture solvent including 50 parts of monochlorobenzene and 50 parts of dichloromethane to prepare a coating for protective layer. The coating for protective layer included, as fluorine atom-containing resin particles, a tetrafluoroethylene resin of 30% by weight relative to the total weight of the protective layer.

The charge transport layer was coated with the application liquid and irradiated with an electron beam under an atmosphere including oxygen at a concentration of 10 ppm at an accelerating voltage of 150 kv in an exposure dose of 50 kGy. Subsequently, heating was performed under the same atmosphere for 10 minutes so that a photosensitive member temperature reached to 100° C., to form a protective layer having a film thickness of 5 μm, to thereby obtain an electrophotographic photosensitive member.

Figure 8:
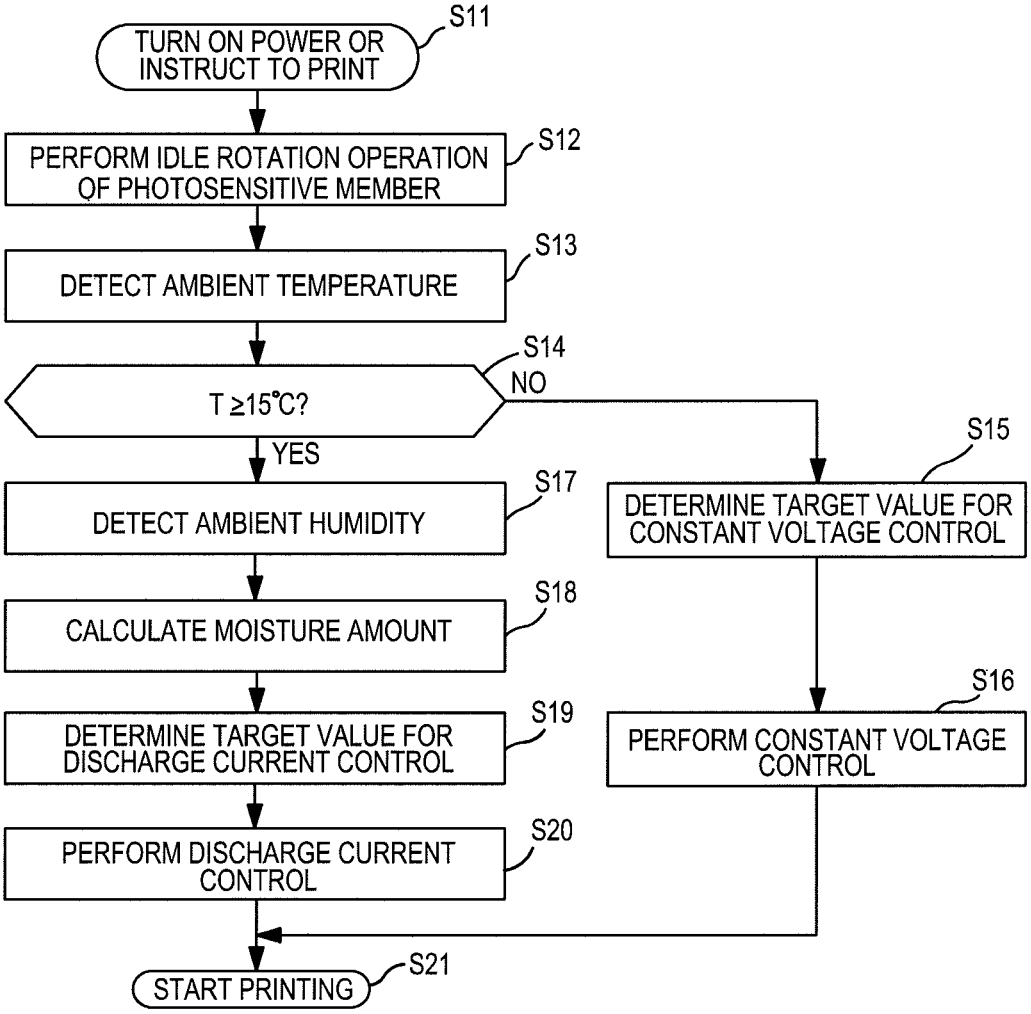
FIG. 8 is a flow chart illustrating an example of processing of the image forming apparatus according to the embodiment of the present invention.

The charging roller and the photosensitive member was incorporated into a copying machine (iR2270) produced by Canon Inc. and image output was performed by a control method as illustrated in FIG. 8. FIG. 8 is a flow chart illustrating an example of processing of the image forming apparatus. In order to realize the processing, a CPU included in the engine control section 17 (FIG. 1) reads a control program stored in a memory (not shown) and executes the control program.

When a power supply of the image forming apparatus is turned ON or after the image forming apparatus receives a printing instruction (Step S11), the image forming apparatus starts an initialization operation (Step S12). During the initialization operation, an idle rotation operation (pre-rotation operation) of the photosensitive member is executed to rotate the photosensitive member. At this time, an ambient (environmental) temperature T is determined by the temperature sensor (Step S13). When the temperature is smaller than a predetermined temperature (15° C. in this example) (No in Step S14), the constant voltage control is selected. In this example, a target value for constant voltage control is determined based on the ambient temperature at this time (Step S15). The constant voltage control is performed based on the determined target value (Step S16). For example, as described later, when there is an environment of 10° C., the control is performed based on a target value for constant voltage control B. After that, printing is started by charge control based on the constant voltage control (Step S21).

When the ambient temperature T is determined to be equal to or larger than the predetermined value (15° C.) in Step S14, an ambient humidity is detected by the humidity sensor (Step S17). An absolute moisture amount (moisture amount in air and moisture mass per unit volume ($g/m^3$)) is calculated based on the temperature and the humidity at this time (Step S18) and a target value for discharge current control (predetermined discharge current amount) is determined based on the moisture amount (Step S19). Then, the discharge current control is performed to determine the voltage value of Vpp corresponding to the determined target value (Step S20). After that, printing is started by charge control using the determined voltage value of Vpp (Step S21).

Figure 9:
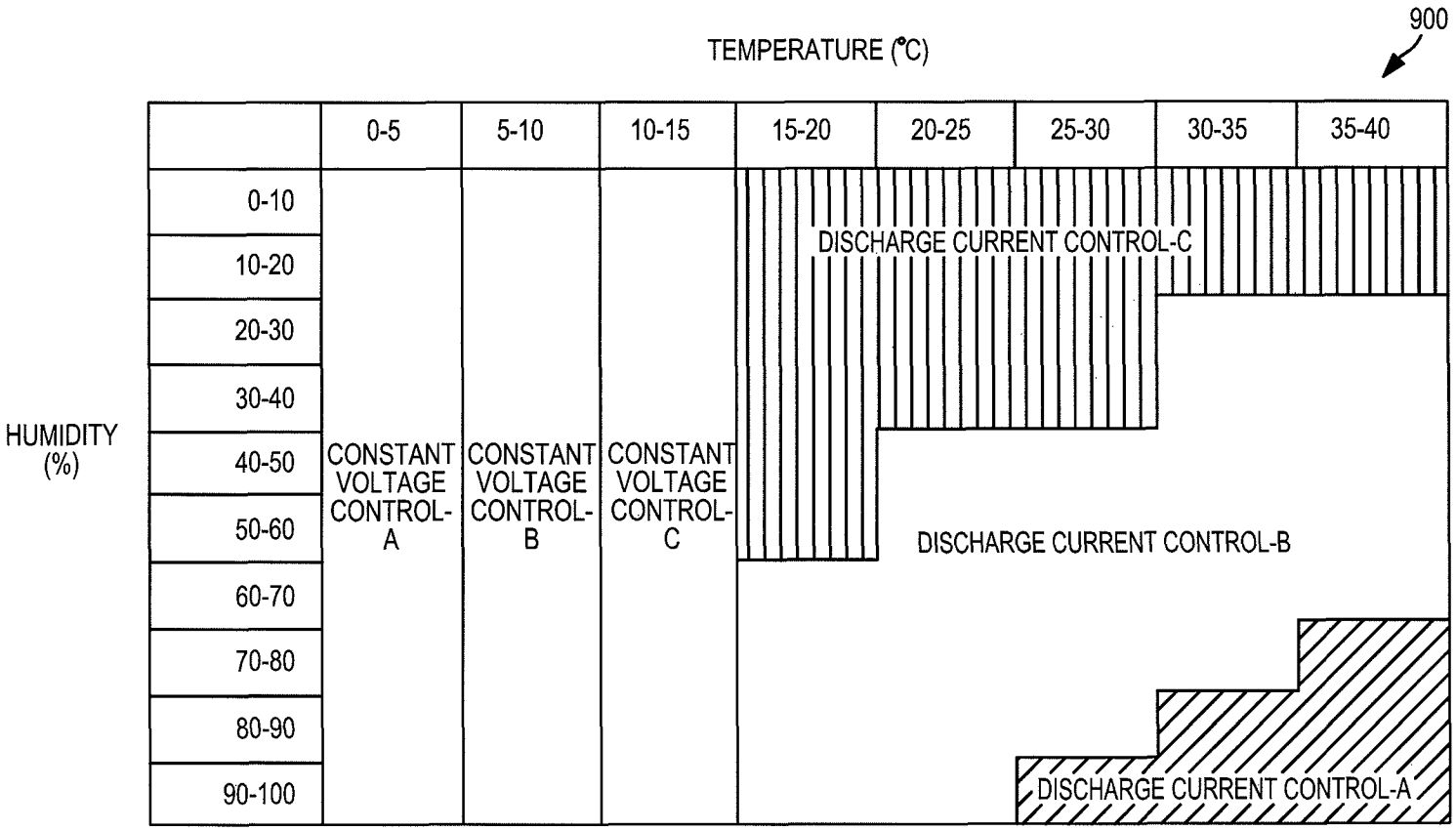
FIG. 9 illustrates an example of an environment table, which is the basis for the processing illustrated in FIG. 8.

FIG. 9 illustrates an example of an environmental table for the processing in this example. An environmental table 900 defines charge control types suitable for environments based on ambient temperature and humidity.

A region in which a temperature is smaller than 15° C. may be divided into multiple regions and constant voltage control-A, constant voltage control-B, and constant voltage control-C with different voltage values may be switched. In this case, the constant voltage control-A is employed in a range of 0° C. to 5° C., the constant voltage control-B is employed in a range of 5° C. to 10° C., and the constant voltage control-C is employed in a range of 10° C. to 15° C. Voltage values of voltages to be applied to the charging unit are determined from voltage values of a charge control table of a storage section so that the constant voltages Vpp used for the constant voltage control-A, the constant voltage control-B, and the constant voltage control-C are reduced in this order (see FIG. 15).

When overdischarging occurs in an environment in which an absolute moisture amount in air is large, an image becomes defective. Therefore, a region in which a temperature is equal to or larger than 15° C. may be divided into multiple regions based on a combination of temperature and humidity to switch discharge current control types. In the example illustrated in FIG. 9, discharge current control-A is employed in a relatively high-temperature and high-humidity range, discharge current control-B is employed in a middle temperature and humidity range, and discharge current control-C is employed in a relatively low-temperature and low-humidity range. Necessary discharge current amounts ΔAC used for the discharge current control-A, the discharge current control-B, and the discharge current control-C are increased in this order. In this example, instead of calculating the absolute moisture amount, a discharge current control type (that is, predetermined discharge current amount value) may be determined based on a region in which a combination of temperature and humidity is placed.

The processing may be executed at the time of first rotation of the image bearing member after the turn-on of the power supply of the image forming apparatus or at the time of rotation of the image bearing member during next printing operation every time the predetermined number of sheets are printed.

According to the structure in Example 1, the discharge current control and the constant voltage control are adequately selected, and hence the discharge current control in the low-temperature environment may be performed without the application of Vpp more than necessary. Therefore, an electrical output may be reduced. As a result, a low-cost electrical circuit may be used and there was not a problem that an image became defective because of the application of excessively high voltage. In such a state, durability was verified. A large problem due to scratching or shaving unevenness of the photosensitive member did not occur. The Vpp values V4, V5, and V6 for the discharge current control were set to 1,200, 1,350, and 1,450 Vpp, respectively. In this case, (V4+V6)/V5=1.963, and hence it is apparent that the condition described above is satisfied.

Example 2

Figure 10:
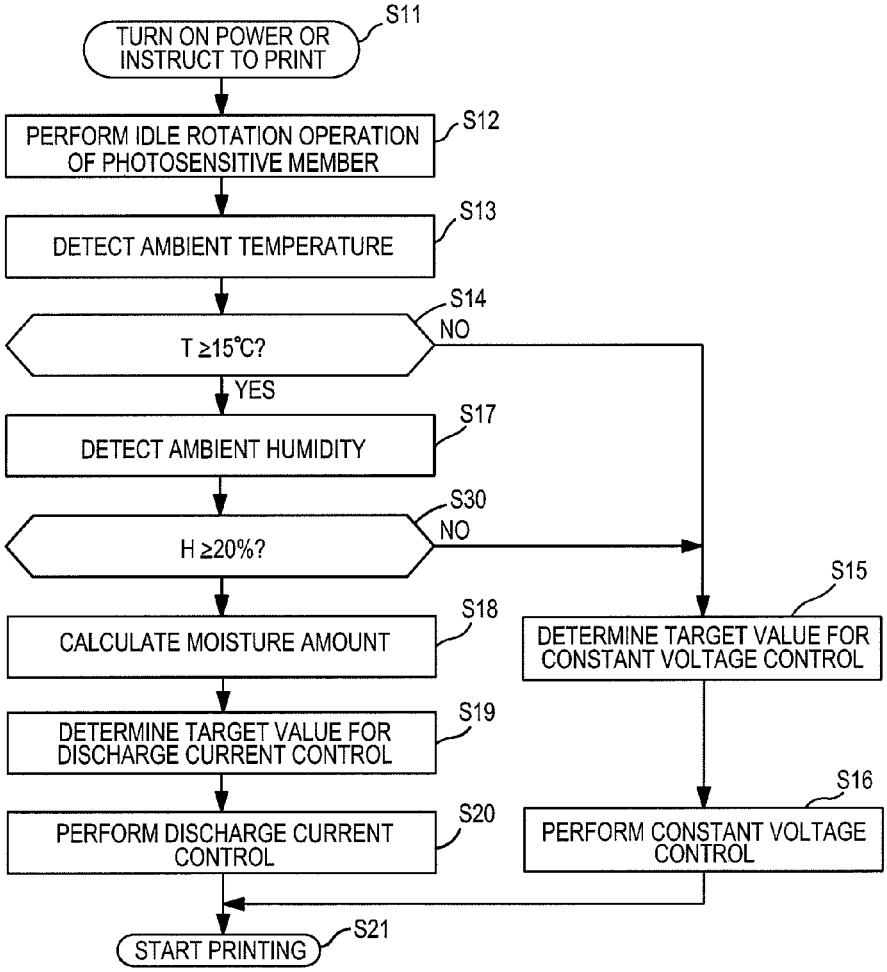
FIG. 10 is a flow chart illustrating another example of processing of the image forming apparatus according to the embodiment of the present invention.

The same charging roller and photosensitive member as in Example 1 were used and image output was performed by processing based on a flow chart as illustrated in FIG. 10. In FIG. 10, the same processing steps as those of FIG. 8 are expressed by the same reference numerals and symbols and the duplicated descriptions thereof are omitted.

The processing illustrated in FIG. 10 is different from the processing illustrated in FIG. 8 in that, after the ambient humidity is detected in Step S17, the detected humidity H is verified (Step S30 is added). In Step S30, when the detected humidity H is equal to or larger than a predetermined value (20% in this example), the processing goes to Step S18. In contrast to this, the detected humidity H is smaller than the predetermined value, the processing goes to Step S15. Therefore, even in the case where the temperature is equal to or larger than the predetermined value, when the humidity is relatively low, image defects do not occur by overdischarging, and hence the constant voltage control is selected.

Figure 11:
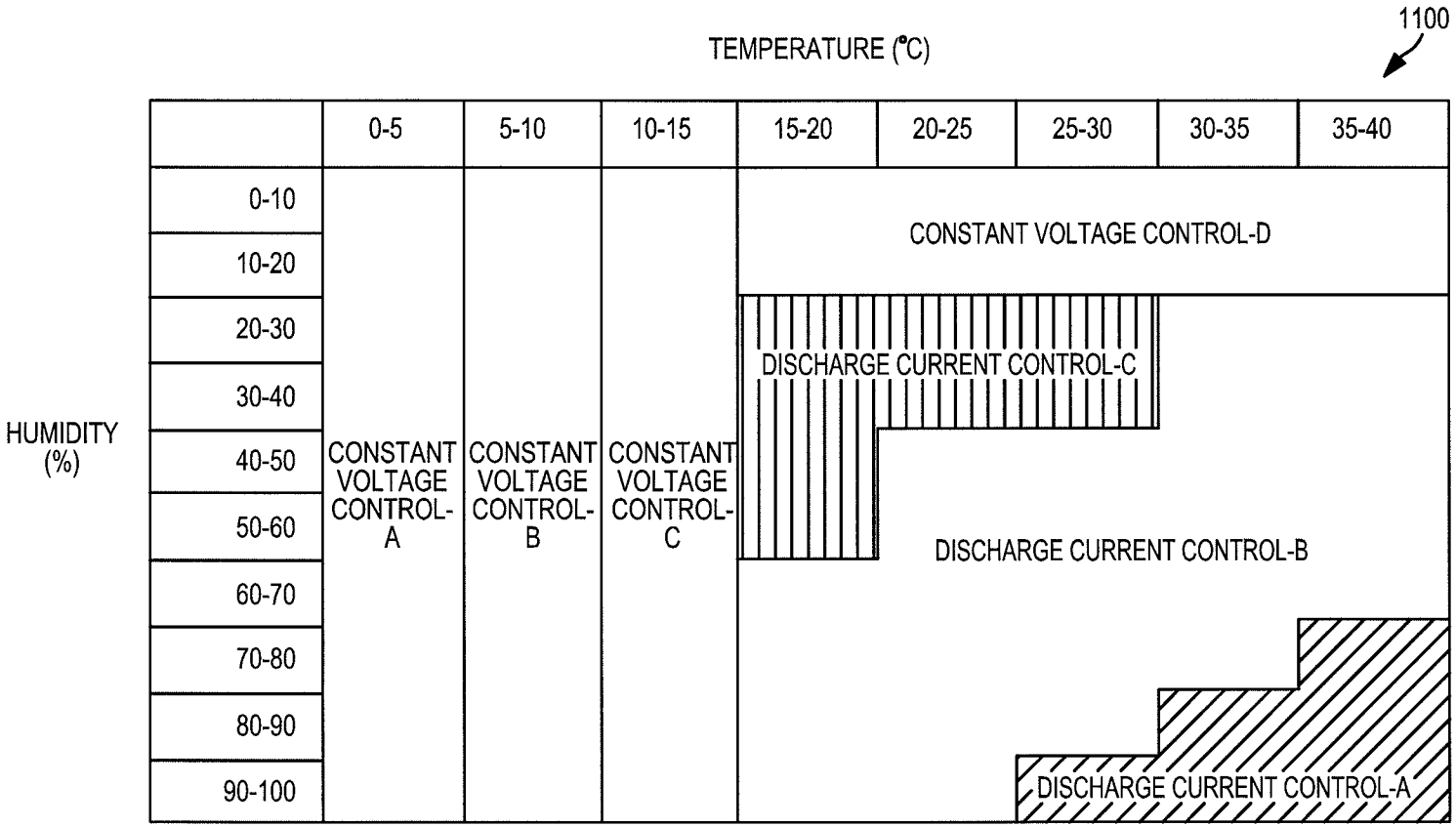
FIG. 11 illustrates another example of the environment table, which is the basis for the processing illustrated in FIG. 10.

FIG. 11 illustrates an example of an environmental table for the processing in this example. An environmental table 1100 defines charge control types suitable for environments based on ambient temperature and humidity. The environmental table 1100 is different from the environmental table 900 illustrated in FIG. 9 in that, when the humidity is relatively low (smaller than 20% in this example) even in the case where the temperature is equal to or larger than 15° C., constant voltage control-D is defined as suitable control. In an environment in which the humidity is relatively low, image defects do not occur by overdischarging, and hence the constant voltage control-D may be the same as the constant voltage control at the temperature lower than 15° C.

The Vpp values V4, V5, and V6 for the discharge current control in Example 2 were the same as in Example 1 and the same effect was obtained.

Example 3

Figure 12:
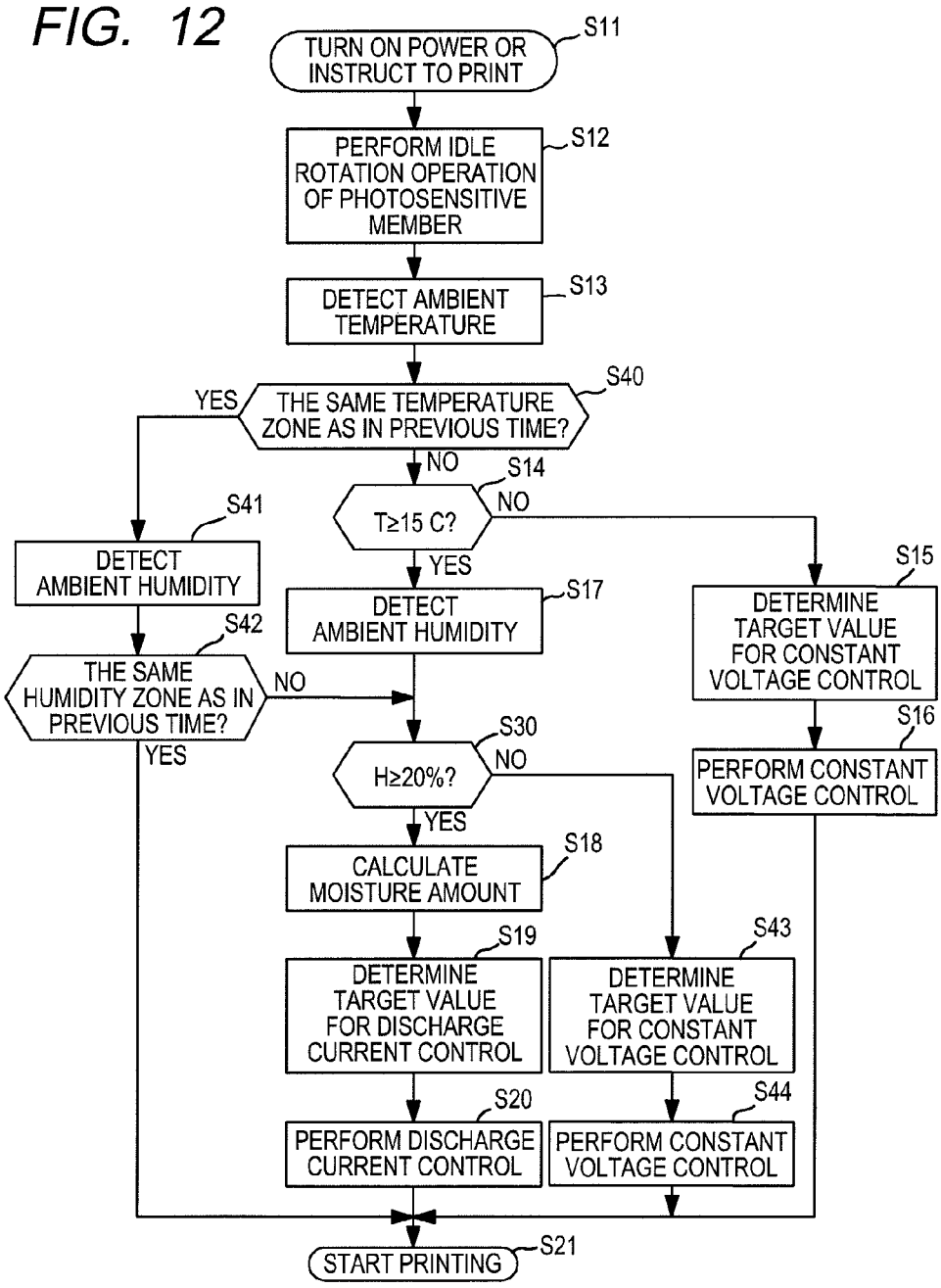
FIG. 12 is a flow chart illustrating another example of processing of the image forming apparatus according to the embodiment of the present invention.

The same charging roller and photosensitive member as in Example 1 were used and image output was performed by processing based on a flow chart as illustrated in FIG. 12. In FIG. 12, the same processing steps as those of FIG. 10 are expressed by the same reference numerals and symbols and the duplicated descriptions thereof are omitted.

In the processing illustrated in FIG. 12, the ambient temperature and humidity during previous charge control and the corresponding charge control type are stored in a nonvolatile memory (not shown) and a charge control method is determined at the time of rotation of the image bearing member during printing operation only in a case where an environment in which the image forming apparatus is placed is changed from the environment determined by previous processing.

To be specific, after the ambient temperature is detected in Step S13, whether or not the currently detected temperature is included in the same temperature zone as that of the previously detected temperature is determined (Step S40). When the currently detected temperature is included in the same temperature zone, the ambient humidity is detected (Step S41) and whether or not the currently detected humidity is included in the same humidity zone as that of the previously detected humidity is determined (Step S42). When the detected humidity is included in the same humidity zone, the processing goes to the start of printing (Step S21). When the detected humidity is not included in the same humidity zone, the processing goes to Step S30 and whether or not the humidity is equal to or larger than 20% is determined. When the humidity is smaller than 20%, a target value different from the target value for the constant voltage control in Step S15 is determined (Step S43) and constant voltage control is performed based on the determined target value (Step S44).

The Vpp values V4, V5, and V6 for the discharge current control in Example 3 were the same as in Example 1 and the same effect was obtained.

Example 4

The same study as in Example 1 was performed except for the point that the following materials are used for the charging roller in Example 1.

| | |
|---|---|
| Epichlorohydrin rubber | 100 parts |
| Liquid polychloroprene | 6 parts |
| Thiourea compound | 2 parts |
| Sulfur | 0.3 part |

Next, a bonding material was applied to the outer circumference of the cored bar (rotation shaft) 11 including the shaft which has a diameter of 8 mm and is made of metal. After that, the cored bar 11 was set to a die for roller molding and maintained at 70° C. The rubber composition was injected into the die and reaction cured for approximately ten minutes to obtain a conductive elastic layer 22 serving as a base of the charging roller 2. The conductive elastic layer 22 was demolded and aged at room temperature for approximately 24 hours. In this case, a diameter is 15 mm. The surface of the roller was ground by a grinder so that the diameter reached to 14 mm. The charging roller was used, and the same study result is obtained as in Example 1.

The Vpp values V4, V5, and V6 for the discharge current control in Example 4 were the same as in Example 1 and the same effect was obtained.

Example 5

Vpp for the discharge current control in Example 1 was changed, and the same study was made as in Example 1. The Vpp values V4, V5, and V6 in this example were set to 1,200, 1,369, and 1,450 Vpp, respectively. In this case, (V4+V6)/V5=1.936, and hence it is apparent that the condition described above is satisfied. This was estimated as in Example 1. According to Example 5, the discharge current control and the constant voltage control are adequately switched, and hence Vpp larger than necessary is not applied in the low-temperature and low-humidity environment. Therefore, a low-cost electrical circuit may be used and there was hot a problem that an image became defective because of the application of excessively high voltage. In such a state, durability was verified. A large problem due to scratching or shaving unevenness of the photosensitive member was not caused.

Example 6

Vpp for the discharge current control in Example 1 was changed, and the same study was made as in Example 1. The Vpp values V4, V5, and V6 in this example were set to 1,100, 1,330, and 1,550 Vpp, respectively. In this case, (V4+V6)/V5=1.992. This was estimated as in Example 1. According to Example 6, the discharge current control and the constant voltage control are adequately switched, and hence Vpp larger than necessary is not applied in the low-temperature and low-humidity environment. Therefore, a low-cost electrical circuit may be used and there was not a problem that an image became defective because of the application of excessively high voltage. In such a state, durability was verified. A large problem due to scratching or shaving unevenness of the photosensitive member was not caused.

Figure 13:
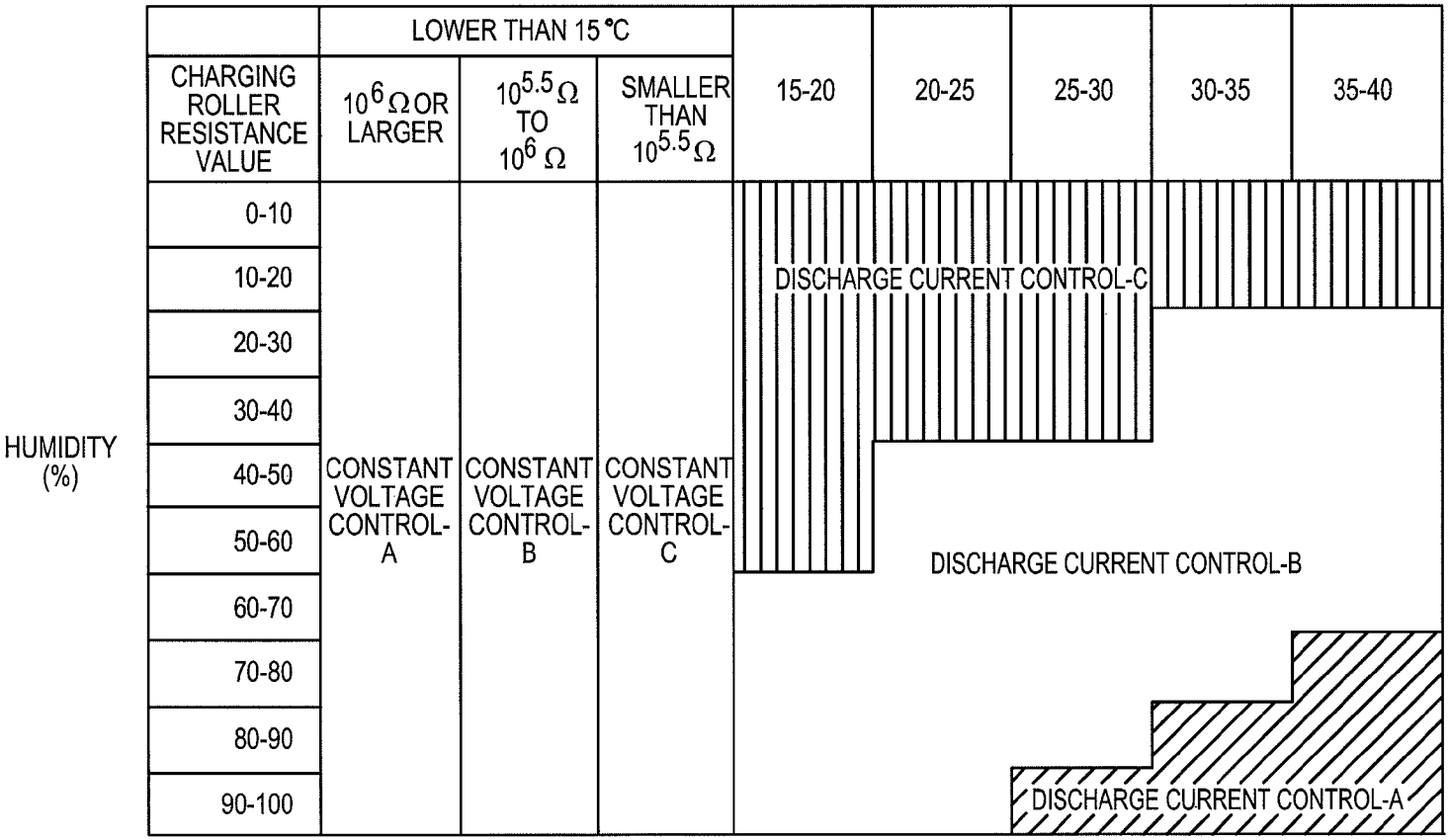
FIG. 13 illustrates another example of the environment table, which is the basis for the processing illustrated in FIG. 10.
Figure 14:
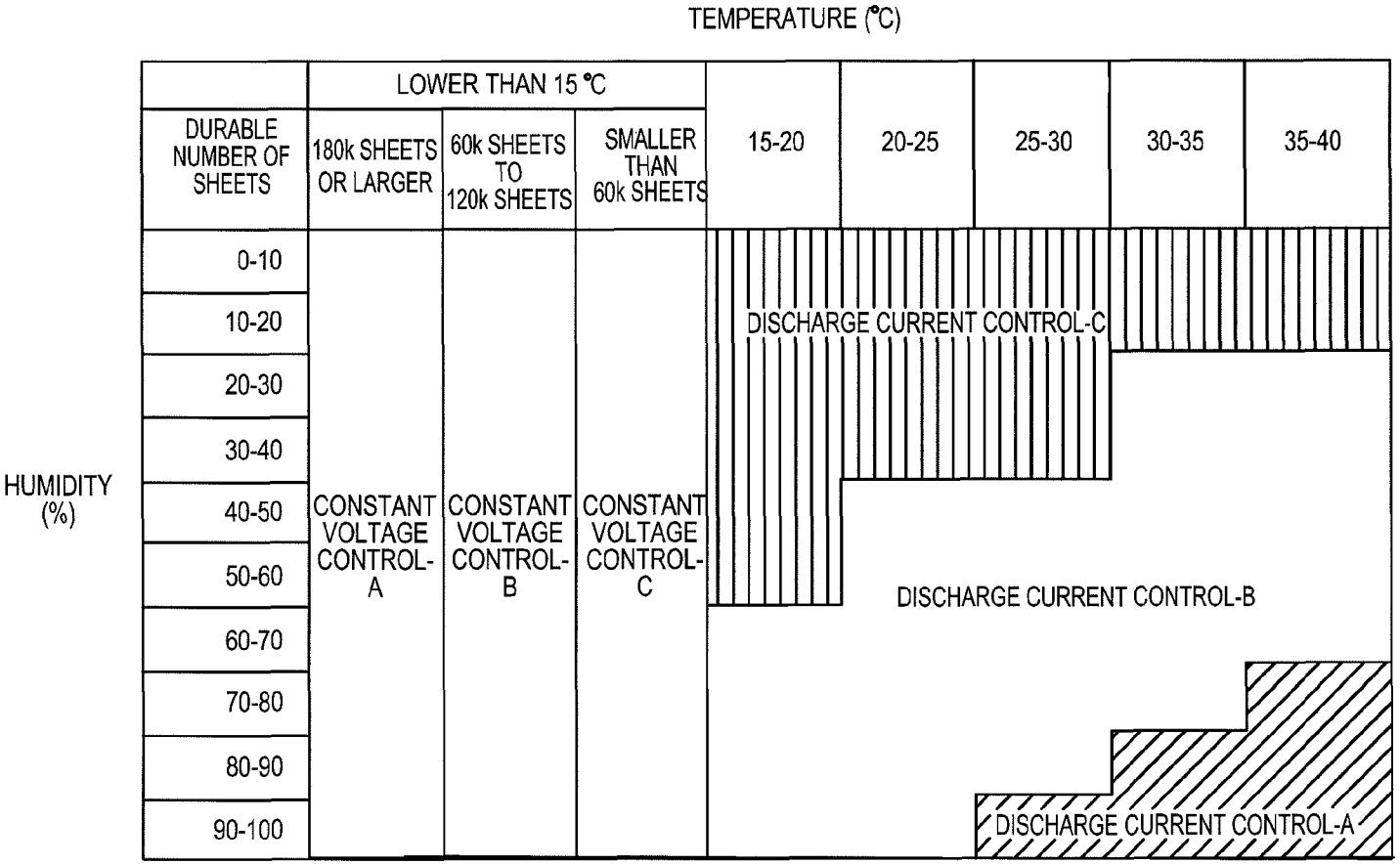
FIG. 14 illustrates another example of the environment table, which is the basis for the processing illustrated in FIG. 10.

In the low-temperature regions of the environment switching tables illustrated in FIGS. 9 and 11 which are a feature of the present invention, the temperature ranges for selecting the constant voltage control-A, the constant voltage control-B, and the constant voltage control-C may be changed to temperature ranges illustrated in FIGS. 13 and 14 based on the resistance value of the charging roller and the durable number of sheets. The resistance value of the charging roller is varied according to durability. In particular, in the low-temperature environment at 15° C. or lower, an image is likely to become defective by charge unevenness because of the inactivation of discharge phenomenon or the influence of the temperature characteristic of the charging roller. Therefore, when the resistance value of the charging roller is varied according to durability, the environmental switching table illustrated in FIG. 9 is changed to the environmental switching table illustrated in FIG. 13 to alleviate image defects caused by the variation in resistance value of the charging roller. Thus, even when the resistance value of the charging roller is varied, the charging roller may be continuously used, and hence the long life of the charging device may be realized.

In a method of measuring the resistance value of the charging roller, a voltage applied to the charging roller 2 illustrated in FIG. 1 is divided by a current measured by a current measurement unit 19 in FIG. 1 to obtain the resistance value. A resistance R of the charging roller is calculated by a charging roller resistance calculation section included in the control section illustrated in FIG. 15, based on a voltage V applied to the charging roller by a voltage applying device illustrated in FIG. 15 and a current value I flowing into the charging roller, which is detected by an AC current detection circuit illustrated in FIG. 15. The resistance is expressed by R=V/I.

Figure 15:
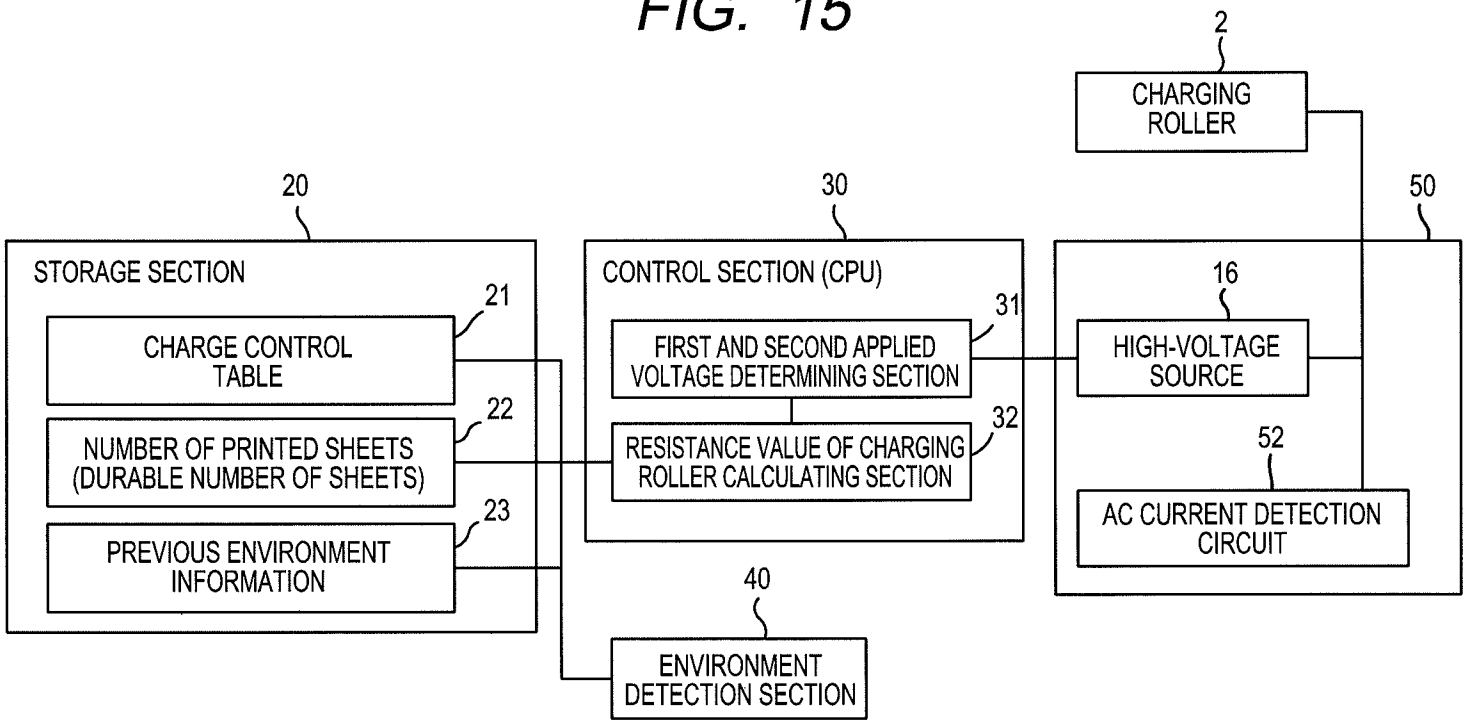
FIG. 15 is a block diagram illustrating an example of constant voltage control.

In the low-temperature regions of the environment switching tables illustrated in FIGS. 9 and 11 which are the feature of the present invention, the temperature ranges for selecting the constant voltage control-A, the constant voltage control-B, and the constant voltage control-C may be changed to the temperature ranges illustrated in FIG. 14 based on the number of sheets that are printed prior to the printing to be performed (durable number of sheets) which is stored in a printed sheet number storage device 20 illustrated in FIG. 15.

The resistance value of the charging roller is varied by depositing paper dusts and toners on the outer circumference during durable use. In particular, in the low-temperature environment at 15° C. or lower, an image is likely to become defective due to charge unevenness because of the inactivation of discharge phenomenon or the influence of the temperature characteristic of the charging roller. Therefore, when the resistance value of the charging roller is varied by contamination during durable use, the environmental switching table illustrated in FIG. 9 is changed to the environmental switching table illustrated in FIG. 14. Thus, while the image defects caused by the variation in resistance value of the charging roller during durable use are alleviated, the long life of the charging device may be realized. The durable number of sheets is updated and stored in a storage unit provided in the image forming apparatus.

Comparative Example 1

In an example compared with Example 5, Vpp for the discharge current control in Example 1 was changed. The Vpp values V4, V5, and V6 in this example were set to 1,250, 1,422, and 1,500 Vpp, respectively. In this case, (V4+V6)/

V5=1.934. This was estimated as in Example 1. As a result, in an environment in which the absolute moisture amount in air is relatively large, image defects occurred because of over-discharging due to ah excessive charge output value. As is apparent from Comparative Example 1, the image defects occur due to the degradation of precision of the discharge current control.

Comparative Example 2

In an example compared with Example 5, Vpp for the discharge current control in Example 1 was changed. The Vpp values V4, V5, and V6 in this example were set to 1,050, 1,279, and 1,500 Vpp, respectively. In this case, (V4+V6)/V5=1.993. This was estimated as in Example 1. As a result, image defects due to charge unevenness occurred because the charge output value was insufficient. As is apparent from Comparative Example 2, the image defects occur due to the degradation of precision of the discharge current control.

Figure 16:
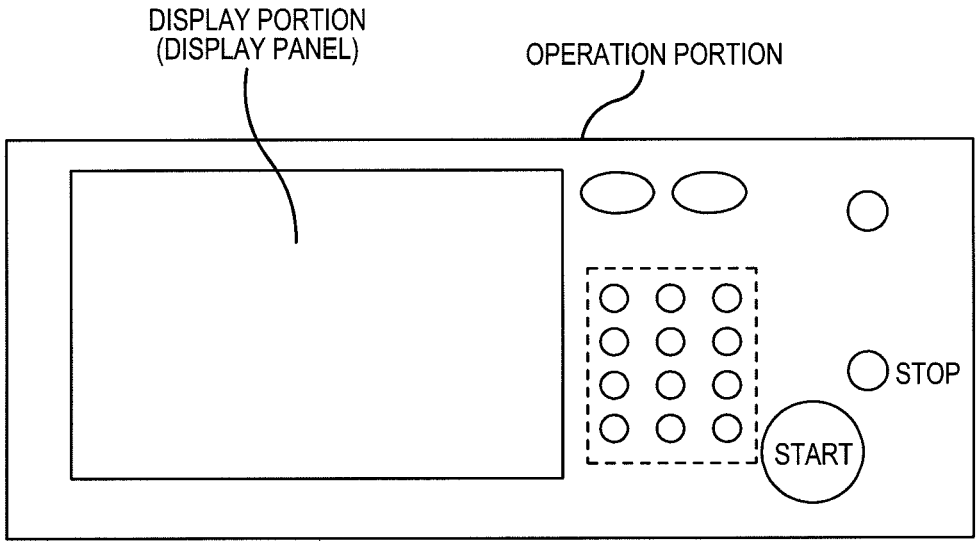
FIG. 16 is a schematic view illustrating an operation portion including an input portion and a display portion.

The exemplary embodiment of the present invention is described. However, various modifications and alternations other than the structures described above may be made. For example, in this embodiment, the main body of the image forming apparatus includes the environment detection unit for detecting the environment information to obtain the environment information. However, the environment detection unit may be omitted. A user of the image forming apparatus may input a use environment with an operation portion (see FIG. 16) of the image forming apparatus (or select on display of operation portion) to obtain the environment information. And then, a control unit may select, as a voltage applied to the charging unit, any one of the voltage values determined by the first and second applied voltage determining units.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-293028, filed Dec. 24, 2009 and No. 2010-278268, filed Dec. 14, 2010, which are hereby incorporated by reference herein in their entirety.

What is claimed is:

1. An image forming apparatus comprising:

an image bearing member which bears an image;

a charging unit which charges the image bearing member;

an environment detection unit which detects an environment condition and outputs environment information corresponding to the detected environment condition;

a first applied voltage determining unit which determines a voltage value of a voltage to be applied to the charging unit that corresponds to a predetermined discharge current amount by obtaining a discharge current amount;

a second applied voltage determining unit which determines a voltage value of a voltage to be applied to the charging unit based on a voltage value stored in advance in a storage unit; and a control unit which adapts the first applied voltage determining unit or the second applied voltage determining unit based on the environment information input from the environment detection unit.

2. An image forming apparatus according to claim 1, further comprising a resistance value calculating unit which calculates a resistance value of the charging unit, wherein the control unit selects the voltage value of the voltage to be applied to the charging unit based on the resistance value calculated by the resistance value calculating unit in a case that the second applied voltage determining unit is adapted.

3. An image forming apparatus according to claim 2, further comprising a storage unit which stores a number of printed sheets, wherein the control unit selects the voltage value of the voltage to be applied to the charging unit based on the number of printed sheets stored in the storage unit in a case that the second applied voltage determining unit is adapted.

4. An image forming apparatus according to claim 1, further comprising a storage unit which stores a use time of the charging unit, wherein the control unit selects the voltage value of the voltage to be applied to the charging unit based on the use time stored in the storage unit in a case that the second applied voltage determining unit is adapted.

5. An image forming apparatus according to claim 1, wherein the voltage to be applied to the charging unit includes an AC voltage, the voltage value being defined by a peak-to-peak voltage of the AC voltage.

6. An image forming apparatus according to claim 1, wherein the environment information includes temperature and humidity as the environment information.

7. An image forming apparatus according to claim 6, wherein the control unit calculates an absolute moisture amount based on the temperature and humidity indicated by the environment information, and the predetermined discharge current amount in the first applied voltage determining unit is determined based on the moisture amount.

8. An image forming apparatus according to claim 6, wherein, even if the temperature indicated by the environment information is equal to or larger than a predetermined value, the control unit adapts the first applied voltage determining unit and determines the voltage value of the applied voltage in a case that the humidity indicated by the environment information is smaller than a predetermined humidity value.

9. An image forming apparatus according to claim 1, wherein the control unit adapts the first applied voltage determining unit and the second applied voltage determining unit, at the time of pre-rotation of the image bearing member in an initialization operation after reception of a printing instruction or after the turn-on of a power supply of the image forming apparatus.

10. An image forming apparatus according to claim 1, wherein, in a case that a relationship between a voltage value of a voltage to be applied to the charging unit and the discharge current amount is obtained in the first applied voltage determining unit, a relationship among the voltage to be applied of three voltage values V4, V5, and V6 in a discharge region satisfy the following expressions:

$$1.934<(V4+V6)/V5<1.993, \text{ and}$$

$$V4<V5>V6.$$

11. An image forming apparatus according to claim 1, wherein the control unit adapts the first applied voltage determining unit in a case that a temperature indicated by the environment information is equal to or larger than a predetermined value, and controls the charging unit based on the voltage value of the voltage to be applied that is determined by the first applied voltage determining unit, and wherein the control unit adapts the second applied voltage determining unit in a case that the temperature indicated by the environment information is smaller than the predetermined value, and controls the charging unit based on the voltage value of the voltage to be applied that is determined by the second applied voltage determining unit.

12. An image forming apparatus according to claim 6, wherein the control unit adapts the first applied voltage determining unit in a case that a temperature indicated by the environment information is equal to or larger than a predetermined value, and controls the charging unit based on the voltage value of the voltage to be applied that is determined by the first applied voltage determining unit, and wherein the control unit adapts the second applied voltage determining unit in a case that the temperature indicated by the environment information is smaller than the predetermined value, and controls the charging unit based on the voltage value of the voltage to be applied that is determined by the second applied voltage determining unit.

13. An image forming apparatus comprising:

an image bearing member which bears an image;

a charging unit which charges the image bearing member;

an operation portion by which environment information is input;

a first applied voltage determining unit which determines a voltage value of a voltage to be applied to the charging unit that corresponds to a predetermined discharge current amount by obtaining a discharge current amount;

a second applied voltage determining unit which determines a voltage value of a voltage to be applied to the charging unit based on a voltage value stored in advance in a storage unit; and a control unit which adapts the first applied voltage determining unit or the second applied voltage determining unit based on the environment information input from the operation portion.

14. An image forming apparatus comprising:

an image bearing member which bears an image;

a charging unit which charges the image bearing member;

a first applied voltage determining unit which obtains a relationship between a voltage applied to the charging unit and a discharge current amount, and which determines a voltage value of a voltage to be applied to the charging unit based on a voltage value of an applied voltage that corresponds to a predetermined discharge current amount; and a control unit which adapts a second applied voltage determining unit, that determines a voltage value of a voltage to be applied to the charging unit based on a voltage values stored in advance in a storage unit, in a predetermined condition in which the voltage value of the voltage to be applied to the charging unit is not determined by the first applied voltage determining unit.

* * * * *